US006758369B2

(12) United States Patent
Morin et al.

(10) Patent No.: US 6,758,369 B2
(45) Date of Patent: Jul. 6, 2004

(54) CONTAINER FOR A STACK OF INTERFOLDED TISSUE SHEETS AND A METHOD FOR MANUFACTURING SUCH A CONTAINER

(75) Inventors: Emmanuelle Morin, Paris (FR); Thami Chihani, Mölnlycke (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 10/167,487

(22) Filed: Jun. 13, 2002

(65) Prior Publication Data

US 2002/0190074 A1 Dec. 19, 2002

Related U.S. Application Data

(60) Provisional application No. 60/298,407, filed on Jun. 18, 2001.

(51) Int. Cl.[7] ..... A47K 10/24

(52) U.S. Cl. ..... 221/48; 221/47; 221/63; 206/233

(58) Field of Search ..... 206/233; 221/63, 221/47, 48; D6/518

(56) References Cited

U.S. PATENT DOCUMENTS

| | | | | |
|---|---|---|---|---|
| D131,684 S | * | 3/1942 | Feinberg et al. | D6/518 |
| 3,986,479 A | | 10/1976 | Bonk | |
| 4,535,912 A | * | 8/1985 | Bonk | 221/46 |
| 4,586,630 A | * | 5/1986 | Loder | 221/46 |
| 5,024,349 A | * | 6/1991 | Haenni et al. | 221/46 |
| 6,053,357 A | | 4/2000 | Yoh | |
| 2001/0019064 A1 | * | 9/2001 | Jacques et al. | 221/63 |
| 2002/0056719 A1 | * | 5/2002 | Morin et al. | 221/63 |
| 2002/0179627 A1 | * | 12/2002 | Huang et al. | 221/63 |

FOREIGN PATENT DOCUMENTS

| | | |
|---|---|---|
| EP | 0331027 | 9/1989 |
| EP | 0 748 748 A1 | 12/1996 |
| EP | 0748748 | 12/1996 |
| JP | 6-263174 | 9/1994 |
| JP | 9-323771 | 12/1997 |

* cited by examiner

*Primary Examiner*—Donald P. Walsh
*Assistant Examiner*—Matthew J. Kohner
(74) *Attorney, Agent, or Firm*—Burns, Doane, Swecker & Mathis, L.L.P.

(57) ABSTRACT

The invention relates to a container for a collection of interfolded or mechanically connected tissue-sheets, the container having a generally planar bottom wall and a top wall and a pair of side walls and a par of end walls connecting the bottom wall with the top wall and an opening provided in at least the top wall for the removal of the tissue-sheets from the container, the stack of interfolded tissue-sheets being placed in the container with at least a pair of edges of a lowermost tissue-sheet placed on the bottom wall and an uppermost tissue-sheet placed near or in contact with the top wall and adjacent to the opening in the top wall. The opening is provided with elongated projections extending from opposite sides of the opening, wherein each projection in an initial position extends across the opening in the plane of the top wall and is positioned adjoining at least one opposing projection, and the projections are arranged in co-operating pairs, wherein each projection has at least one inner section having a smaller width than an adjacent outer section.

21 Claims, 20 Drawing Sheets

CONTAINER FOR A STACK OF INTERFOLDED TISSUE SHEETS AND A METHOD FOR MANUFACTURING SUCH A CONTAINER

This application claims priority under 35 U.S.C. § 119 to U.S. Provisional Application No. 60/298,407 entitled A Container for a Stack of Interfolded Tissue Sheets and a Method for Manufacturing Such a Container and filed on Jun. 18, 2001, the entire content of which is hereby incorporated by reference.

TECHNICAL AREA

The invention pertains to a stack of interfolded tissue-sheets packed in a container, said container having a generally planar bottom wall and a top wall and side walls connecting the bottom wall with the top wall and an opening provided in at least one wall for the removal of said tissue-sheets from the container, said stack of interfolded tissue-sheets being placed in said container with at least the edges of a lowermost tissue-sheet placed on the bottom wall and an uppermost tissue-sheet placed near or in contact with the top wall and adjacent to the opening in the top wall.

BACKGROUND OF THE INVENTION

Soft tissue sheets such as facial tissue sheets are commonly offered as a stack of tissue sheets packed in a dispensing box. The dispensing box has an opening through which the user pulls the tissue sheets. In order to facilitate the removal of the tissue sheets from the dispensing box, the tissue sheets are interfolded, which means that the tissue sheets are folded into one-another, so that they form a chain of tissue sheets being interconnected by folded portions. In this manner, when removing the top tissue sheet from the stack of tissue sheets and pulling the tissue sheet completely through the dispensing opening in the dispensing box, the pulled-out tissue sheet will automatically bring a portion of the next tissue sheet in the stack out through the opening thereby making it readily available for gripping and removing from the dispensing box. The praxis of interfolding tissue sheets in this manner is a convenient way of ascertaining that all of the tissue sheets can be easily removed from the container. There are many types of interfolding, e.g. Z-folding, but neither the type of interfolding, nor the type of tissue is important to the invention.

A dispenser of this type is known from U.S. Pat. No. 6,053,357 (YOH), which discloses a box with a dispensing opening having a curvilinear or "S"-shape. The opening facilitates the dispensing of interfolded tissues from a box by fixing the top sheet in a position extending out through the opening, where it is readily accessible to a user.

However, a problem arises when it is desired to dispense a flat tissue sheet from the stack of tissue sheets. After opening the dispensing box, which basically means exposing the opening in the box, the user must try and get a grip on the first tissue sheet in order to remove it. In ordinary boxes of this type, the uppermost tissue is usually wrinkled when it is presented to the user through the opening in the box. The reason for this is that the width of the tissue is broader than the opening in the box, in order to fix the tissue in a position ready to use. To dispense a flat tissue sheet it is therefore necessary to have a wider opening in the box. Although a wider opening in the box solves the problem with tissues being wrinkled as they are pulled out of the box, it creates a further problem with tissues falling back into the box where they are inaccessible for the user.

Hence, there exists a great need of improving the dispensing of flat tissue sheets from a stack of tissue sheets. The sheets should both be presented to a user, without falling back into the box, and be possible to withdraw without causing the sheet to wrinkle. Hence, the box requires a dispensing means that enables a tissue to be gripped and held securely in a presentation position, while allowing it to be pulled freely from the box by the user.

DISCLOSURE OF INVENTION

The present invention offers a simple and expedient means of solving the problem of dispensing a flat tissue sheet from a stack of interfolded tissue sheets which are packed in a container having a dispensing opening. In a preferred embodiment, the opening is wider than the width of said tissue sheets. The invention will, however, also be applicable for openings of equal or narrower width than the width of the tissue sheets.

In accordance with the invention the dispensing opening is provided with means for presenting a tissue blocked in a fixed position, with a flat configuration. This allows the user to pull the presented tissue out flat, whereby potential wrinkling is smoothened out by the presenting means. The presented tissue may be a single sheet, or may itself have additional folding.

The means for presenting the tissue is preferably in the form of a number of elongated projections or fingers extending from opposite sides of the dispensing opening of the box. The dispensing opening is preferably, but not necessarily, located in the top wall of the box. In order to fix a tissue in position the fingers are overlapping by extending between each other in the plane of the top wall. When the box is to be opened the fingers are initially arranged in substantially the same plane, until the first tissue has been extracted through the dispensing opening. The fingers may be attached to the underside of the top wall of the box, on opposite sides of the opening. It is also possible to attach the means including said fingers on the upper side of the top wall of the box, or to integrate it into the top wall itself, e.g. by making the fingers part of the top wall. When the first tissue is being pulled out through the opening, the fingers will be pulled upwards by the tissue on either side thereof. The pulled-out tissue will automatically bring a portion of the next tissue out through the opening, where it will pass between the fingers. As the first tissue is removed, the subsequent tissue will be held in position and prevented from falling back into the box by the gripping action of the opposing fingers. The fingers must be sufficiently flexible to allow a tissue to be pulled out, while at the same time being sufficiently stiff to retain the tissue and prevent it from falling back. Accordingly, the thickness and stiffness of a plastic film, or other suitable material, used for the fingers must be selected to match the stiffness and material properties of the tissue.

It is possible to produce opposing sets of fingers from a continuous sheet of material by using an interlocking profile for the projections or fingers extending from opposite sides of the edge of an opening in said sheet. This is achieved by allowing each projection to extend across said top wall, and in the plane thereof, into a recess adjoining at least one opposing projection. If the finger profile is substantially V- or U-shaped, a shaped zig-zag cut can be made along the longitudinal axis of a prospective opening in the continuous sheet. Fingers of this type can be arranged staggered, having fingers arranged side-by-side and overlapping by extending across the dispensing opening of the box, perpendicular to the longitudinal axis of the opening. Alternatively the fingers can be angled relative to the longitudinal axis of the opening. The shape of the projections or fingers will be described in more detail below.

In the following text the term "overlap", in the context of pairs of interacting projections, is used to denote that the tips of a pair of adjacent projections, which are not necessarily in contact, extend past each other, as seen in a plan view. This is the case when the fingers are in their initial positions, before the first tissue has been dispensed. Once a tissue has been withdrawn, the opposing fingers are placed on opposite sides of the subsequent tissue to present it to the user. The fingers are then bent or flexed away from the top wall, to assume a dispensing position in the form of a mainly curved shape. An opposing pair of fingers, or the tips thereof, on either side of a tissue will be in point or line contact with said tissue, thus creating sufficient friction to prevent the tissue from falling back into the box.

The shape of the fingers is important in order to retain a gripping position. Particularly, the tips of a pair of opposing fingers should be relatively large or "fat" to provide said point or line contact with a tissue.

According to a first embodiment, at least one pair of opposing projections is provided with at least one outer section with a surface area that is larger than the surface area of a corresponding length of an inner section. Said first and second sections may or may not partially overlap. In one particular version of this embodiment, the area of the outer section extending past a central longitudinal axis of the opening is larger than the surface area of the inner section from said axis to a base of the projection.

According to a second embodiment, each projection of at least one pair of opposing and co-operating projections has at least one inner section having a smaller width than an adjacent outer section. The widths can be measured at any point on the main axis of said projection. Also, said width of the respective inner and outer sections is the cross-sectional width in the perpendicular direction of either the main axis of said projection or the main, longitudinal axis of said opening.

According to a third embodiment, the radius of a projection at the point of contact with an opposing projection, in the dispensing position, is greater than half the width of the projection at its narrowest section.

According to a fourth embodiment, the opening in the top wall comprises a shaped slot provided with said projections. In addition, said slot can have at least one cut-out section for allowing access to said uppermost tissue-sheet. Said cut-out section may be removed during the manufacture of the box, or during opening of the box to allow access to the tissues.

According to a fifth embodiment, the main, longitudinal axis of the opening containing said slot extends across the top wall along or parallel to a longitudinal axis of the top wall. The opening may thus be positioned along the centre-line of the box, or on either side thereof.

According to a sixth embodiment, the main axis of the opening containing said slot extends across the top wall at an angle relative to the longitudinal axis of the top wall. The angle can be given any value on either side of said longitudinal axis up to and including an angle corresponding to the angle of a diagonal line between opposing corners of the top wall.

According to a seventh embodiment, the main axis of the opening containing said slot extends across the top wall in a generally S-shaped curve extending in the general direction of a line connecting the ends of the opening.

The shape of the edges of the opening can follow the shape or curvature of the main axis of the opening, but can also follow a curved or broken line in the general direction of said axis. In general, the width of the opening is greater or greatest near the middle of the top wall, while its narrowest section is at or near the end sections of the top wall. The end sections of the opening may end in a straight line at the respective edges of the top wall. However they may also end with a rounded section, either near the edges of the top wall or extending a small distance down the respective end walls of the box.

According to a further embodiment, said slot is an insert attached to the top wall, which insert covers the opening. The insert may be made from a plastic material, such as polypropylene, in order to give both sufficient flexibility and stiffness. The flexibility and stiffness may also be varied by using plastic materials of different thickness.

The opening can be used to control the flexibility and stiffness of the fingers arranging the edge of the opening at a predetermined distance from said fingers. A wide opening positioned away from the base of the fingers will give high flexibility and low stiffness. On the other hand, an opening having an edge overlapping the recesses of opposing fingers will give low flexibility and high stiffness. In this way the fingers may be adapted for tissues of different materials and materials of different thickness.

According to a further embodiment, said slot is arranged in the top wall, which then makes up the opening. In this case the box itself is made from a plastic material, having projections or fingers cut or perforated in the top wall. The opening, which would normally control the movement of the fingers, can be embossed directly on the top wall. It is also possible to provide each individual finger with a specific embossing or pattern, in order to give each finger a predetermined flexibility. The shape of the slot containing the projections or fingers or the positioning and shape of the embossed opening can be the same as described in connections with the embodiments above.

In a further embodiment, any two consecutive pairs of opposing fingers should co-operate independently. Hence, a cut line between adjacent fingers of two pairs of opposing fingers should only have one inflection point. In the vicinity of the inflection point, the cut line should be straight or have a comparatively large curvature. In this way it is ensured that each pair of opposing fingers can move and flex together without interference from adjacent pairs of fingers.

BRIEF DESCRIPTION OF DRAWINGS

Particular embodiments of the invention are described below, with reference to the drawings, wherein.

The above figures show schematic representations of various parts of a limited number of possible embodiments of a box according to the invention.

MODES FOR CARRYING OUT THE INVENTION

FIGS. 1A–F show a plan view of a top wall 1 of a box including a pair of folded out end walls 2, 3. The box also includes two side walls, which together with the end walls connect the top wall with a bottom wall (not shown). The box encloses a stack of interfolded tissues to be dispensed through an opening. The following examples describe the opening arranged in the top wall, but it can of course be arranged in any of the said walls. Obviously, the stack of folded tissues would need to be adapted accordingly.

Figure 1A:
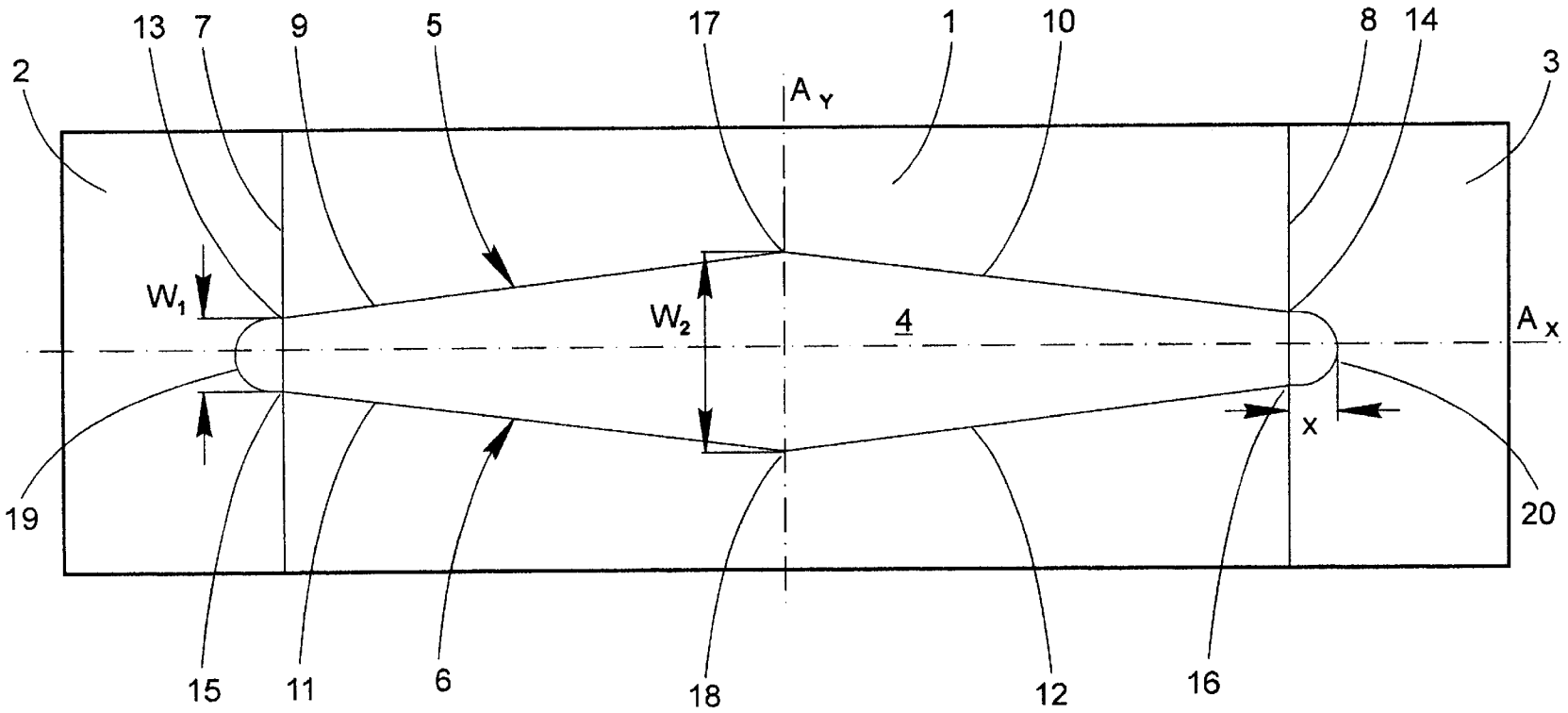
FIG. 1A shows a plan view of a top wall and two folded out end walls of a box, which box is provided with a dispensing opening having a first alternative shape.

The figures illustrate a number of different configurations for a dispensing opening 4 in the top wall 1. In FIG. 1A the edges 5, 6 of the opening are arranged symmetrically on either side of a central longitudinal axis $A_X$ of the box, thus coinciding with the main axis of the opening 4. The opening 4 has its minimum width $W_1$ in the top wall at a folding line 7, 8 between the top wall 1 and each respective end wall 2, 3. The maximum width $W_2$ of the opening 4 is placed at a central transverse axis $A_Y$ of the box. In this first alternative shape, each edge 5, 6 is made up of straight lines 9, 10, 11, 12 from a point 13, 14, 15, 16 where the edge intersects said folding line 7, 8 to a point 17, 18 where the edge 5, 6 intersects the transverse axis $A_Y$ and the opening 4 reaches its maximum width $W_2$. In this particular embodiment, the opening 4 extends past the folding line 7, 8 a short distance X into the respective end wall 2, 3. The opening 4 is terminated by a rounded edge 19, 20, having a substantially semicircular shape. The invention is, however not limited to this shape.

The embodiment of FIG. 1A shows an opening wherein the straight lines continue a short distance into the end walls before being terminated. It is, however, also possible to place the rounded edge on or immediately after the g folding edge, or to terminate the opening along the folding line (see FIG. 1B). If a stack of tissues (not shown) does not take up the entire space between the end walls, it is also possible to terminate the opening before it reaches the folding lines.

Figure 1B:
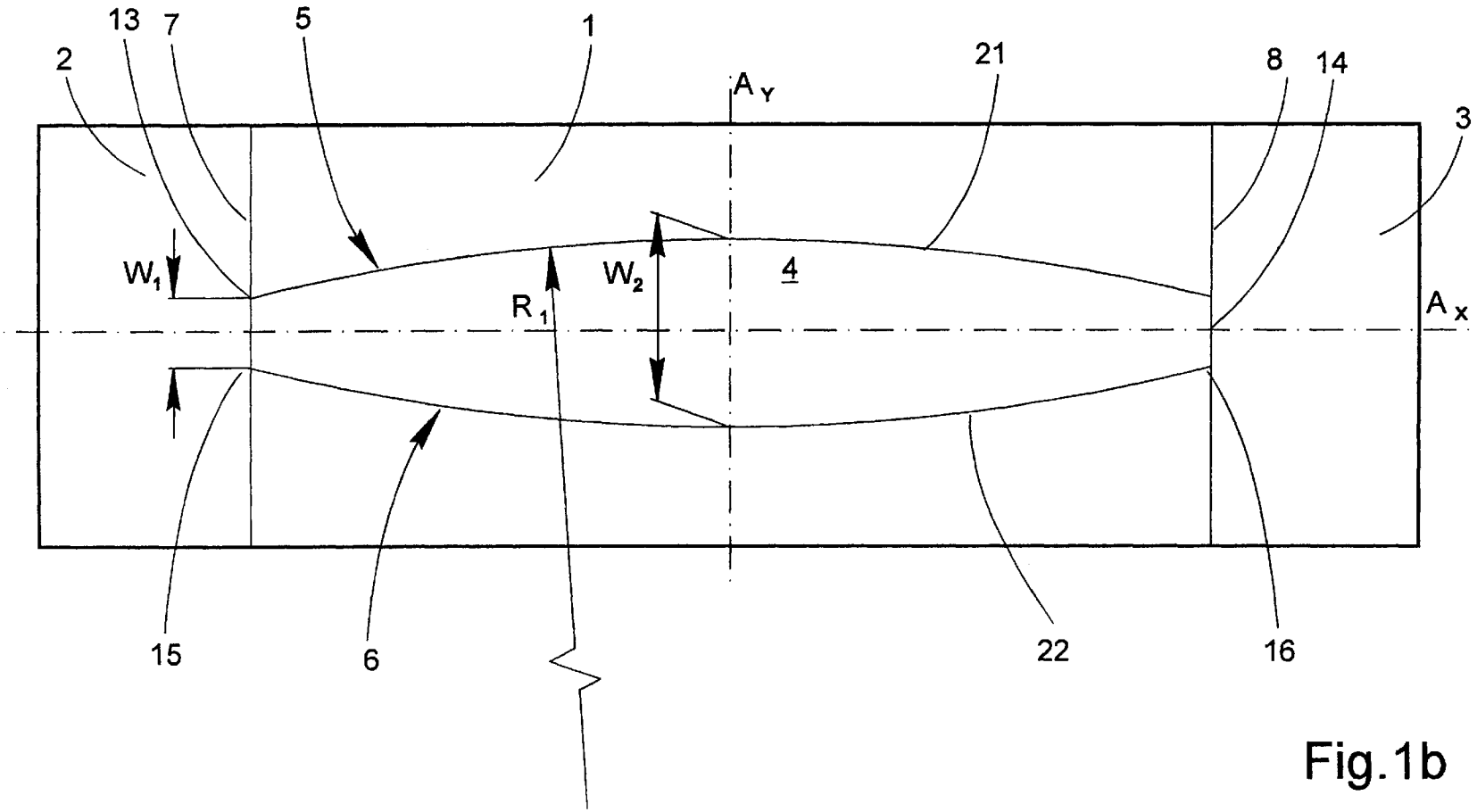
FIG. 1B shows a plan view of a box as in FIG. 1, provided with an opening having a second alternative shape.

FIG. 1B shows an opening 4 having a second alternative shape. In this case, each of the edges 5, 6 are in the shape of a curve 21, 22 having a fixed radius $R_1$ placed symmetrically on both sides of the longitudinal axis $A_X$. Hence, the curve 21 will intersect the points 13 and 14 on the folding line 7, as well as the point 17 on the transverse axis $A_Y$. This embodiment also shows an opening having its ends terminated along the folding lines 7, 8. However the opening 4 does not extend into the side walls 2, 3, but ends at the folding lines 7, 8.

Figure 1C:
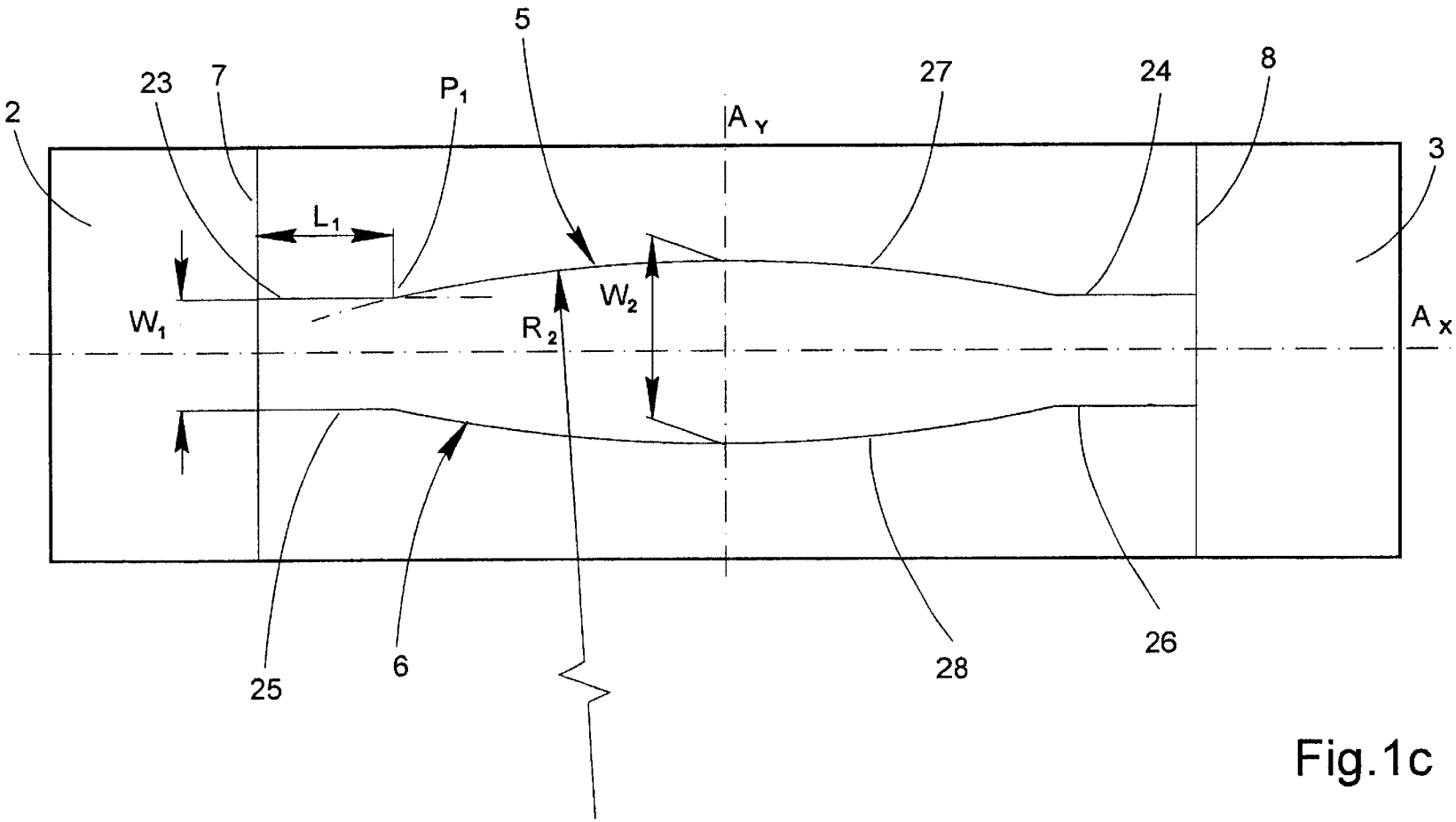
FIG. 1C shows a plan view of a box as in FIG. 1, provided with an opening having a third alternative shape.

FIG. 1C shows an opening 4 having a third alternative shape. Here, the edges 5, 6 have a composite shape comprising straight lines and curves placed symmetrically on both sides of the longitudinal axis $A_X$. Starting from any one point 13, 14, 15, 16 on the folding line 7, 8, a first straight line 23, 24, 25, 26 making up the edge 5, 6 extends parallel to the axis $A_X$ a predetermined distance $L_1$. At an intersection point $P_1$ the line will transform into a curve 27, 28 having a fixed radius $R_2$, which curve will intersect the point 17, 18 on the transverse axis $A_Y$. The edge 5, 6 can make either a smooth or a sharp transition at the intersection point $P_1$. This embodiment also shows an opening 4 having both its ends terminated along the folding lines 7, 8.

For all the above examples, it is also possible to displace the opening in the top wall in the direction of the transverse axis $A_Y$, parallel to the longitudinal axis $A_X$.

Figure 1D:
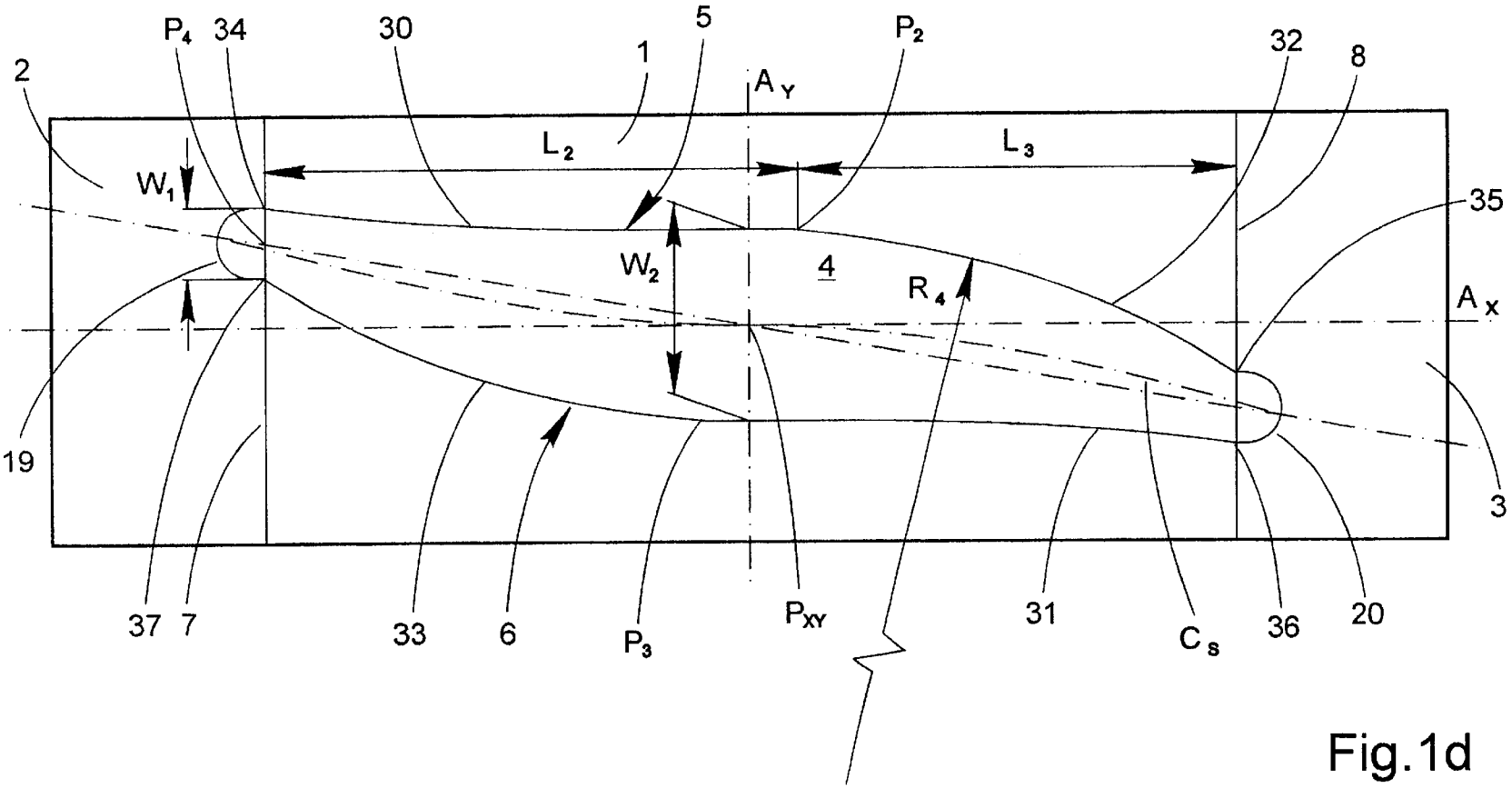
FIG. 1D shows a plan view of a box as in FIG. 1, provided with an opening having a fourth alternative shape.

FIG. 1D shows an opening 4 having a fourth alternative shape. In this example the main axis $A_M$ of the opening 4 is placed at an angle $\alpha$ relative to the longitudinal axis $A_X$ of the box. The main axis $A_M$ has thereby been rotated around the point $P_{XY}$ of intersection between the longitudinal and transverse axes $A_X$ and $A_Y$. The points 34, 35, 36, 37 where the edges 5, 6 intersect the folding lines 7, 8 have been placed symmetrically on either side of a point $P_M$, where the main axis $A_M$ intersects said folding line 7, 8. When starting from the point 34, 36 on the folding line 7, 8 furthest away from the longitudinal axis $A_X$, the edge 5, 6 is initially in the shape of a first curve 30, 31 that is concave in relation to the main axis $A_M$. The radius $R_3$ of this curve 30, 31 has its centre located outside the opening 4 and on the same side of the main axis $A_M$. The curve 30, 31 extends a predetermined distance $L_2$ to a point $P_2$, $P_3$, a short distance past the transverse axis $A_Y$. At the point $P_2$, $P_3$ the first, concave curve 30, 31 will transform into a second, convex curve 32, 33 having a fixed radius $R_4$. The radius $R_4$ of this curve 32, 33 has its centre located outside the opening 4 and on the opposite side of the main axis $A_M$ as the curve. The second curve 32, 33 extends from the transition point $P_2$, $P_3$ to the point 35, 37 on the folding line 7 closest to the longitudinal axis $A_X$. The transition between the curves 30, 32 and 31, 33 respectively at the point $P_2$, $P_3$, can be either smooth or sharp. The second edge 6 of the opening is inversely symmetrical to the first edge 5 relative to the main axis $A_M$. Hence the centreline $C_S$ of the opening will follow a substantially S-shaped curve. Depending on the choice of radii $R_3$, $R_4$ and the positioning of their centres in relation to the transverse axis $A_Y$, the position of the maximum width $W_2$ need not coincide with said axis $A_Y$. In the current example, the width $W_2$ is substantially constant in the space between the transition points $P_2$, $P_3$. As in the case of the embodiment shown in FIG. 1A, the opening 4 extends past the folding line 7, 8 a short distance X into the respective end wall 2, 3. The opening 4 is terminated by a rounded edge 19, 20, having a substantially semicircular shape.

Figure 1E:
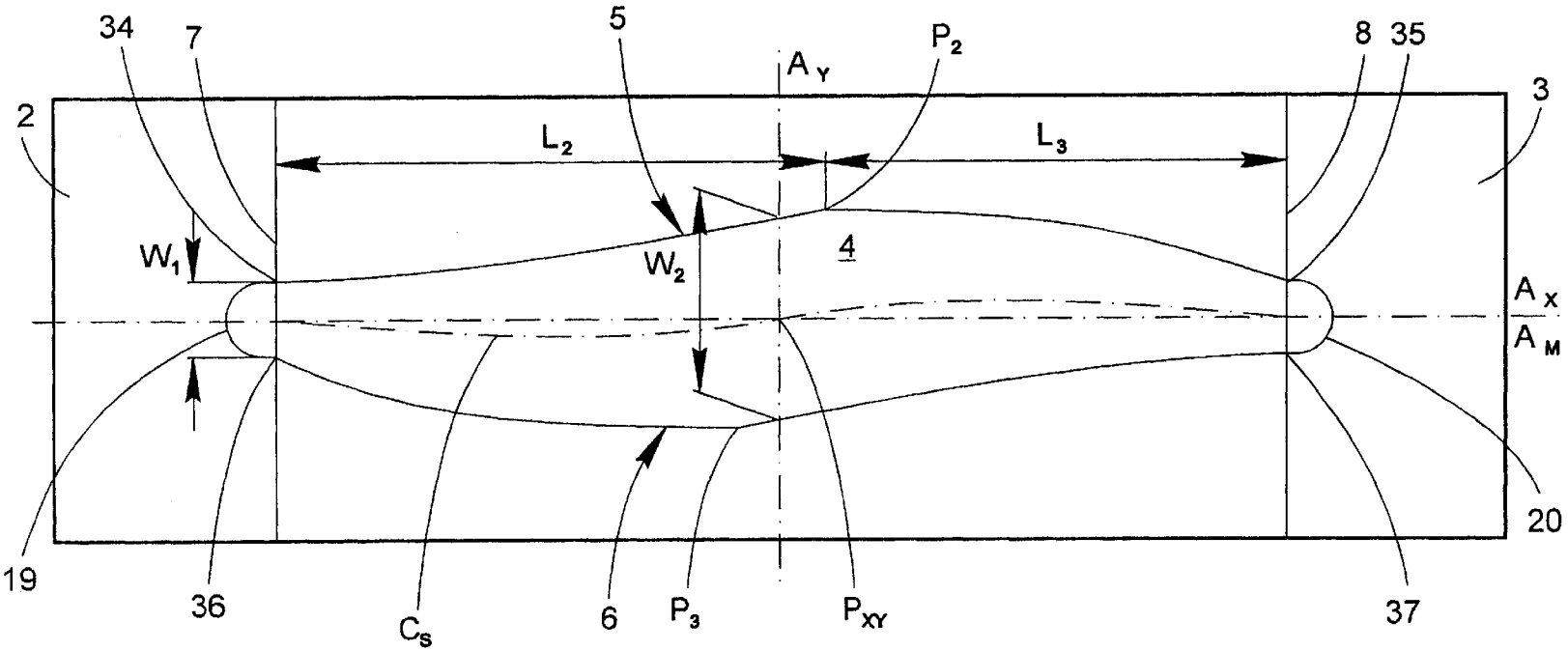
FIG. 1E shows a plan view of a box as in FIG. 1, provided with an opening having a fifth alternative shape.

FIG. 1E shows an opening 4 having a fifth alternative shape, which is substantially identical to the shape shown in FIG. 1D. The major difference is that the main axis $A_M$ of the opening has been rotated anti-clockwise to coincide with the central axis $A_X$ of the box. Hence, the points 34, 35, 36, 37 on the folding line are positioned symmetrically on either side of both the main axis $A_M$ and the longitudinal axis $A_X$.

Figure 1F:
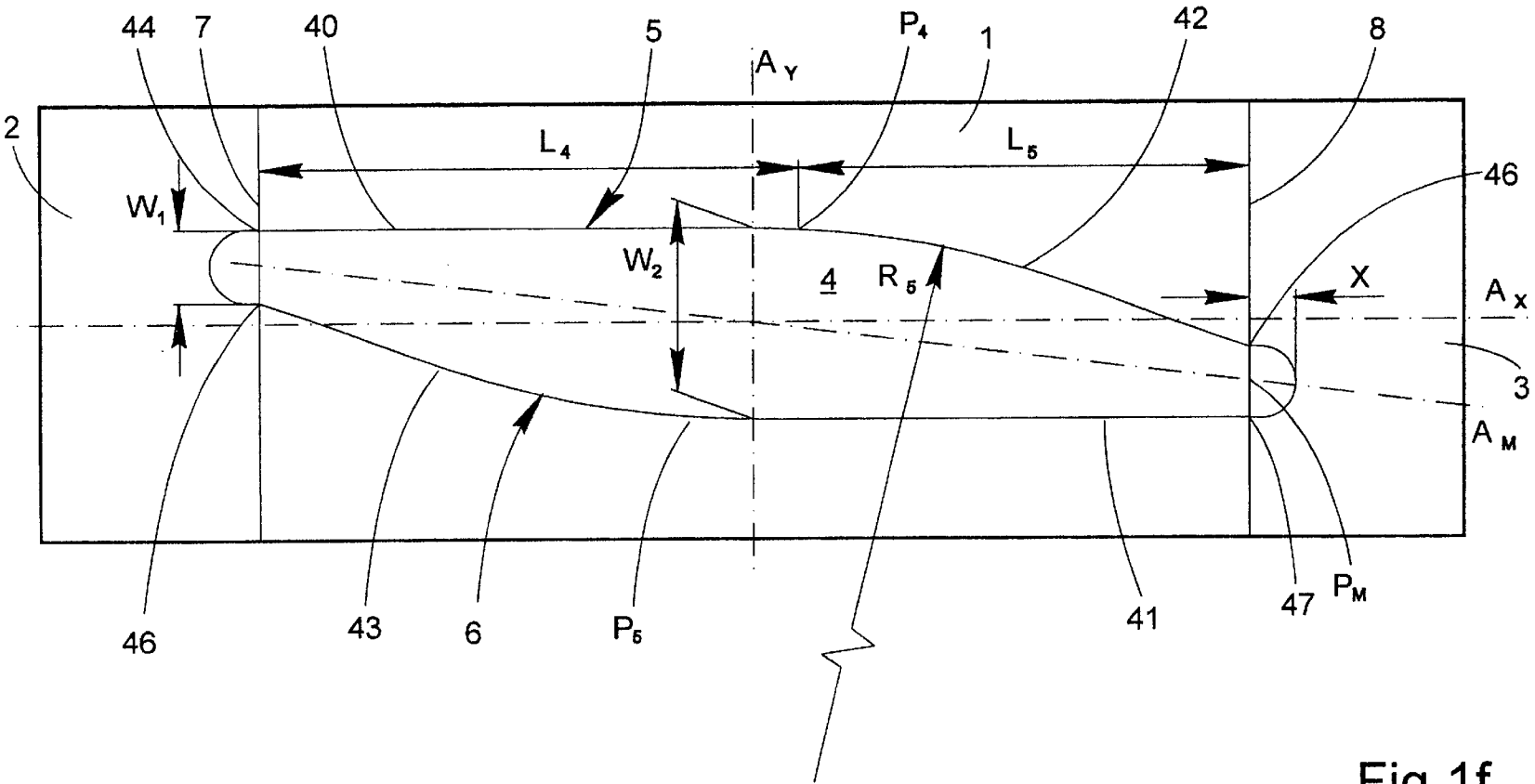
FIG. 1F shows a plan view of a box as in FIG. 1, provided with an opening having a sixth alternative shape.

FIG. 1F shows an opening 4 having a sixth alternative shape. As shown in FIG. 1D, the main axis $A_M$ in this example has been rotated an angle $\alpha$ relative to the longitudinal axis $A_X$, around the point of intersection between the two main axes $A_X$ and $A_Y$. The points 44, 45, 46, 47 where the edges 5, 6 intersect the folding lines 7, 8 have been placed symmetrically on either side of the point $P_M$, where the main axis $A_M$ intersects said folding line 7, 8. When starting from the point 44, 46 on the folding line 7, 8 furthest away from the longitudinal axis $A_X$, the edge 5, 6 is initially in the shape of a straight line 40, 41 parallel with the longitudinal axis $A_X$. The line 40, 41 extends a predetermined distance $L_4$ to a point $P_4$, $P_5$, a short distance past the transverse axis $A_Y$. At the point $P_4$, $P_5$ the straight line 40, 41 will transform into a convex curve 42, 43 having a fixed radius $R_5$. The radius $R_5$ of this curve 42, 43 has its centre located outside the opening 4 and on the opposite side of the main axis $A_M$ as the curve. This curve 42, 43 extends from the transition point $P_4$, $P_5$ to the point 45, 47 on the folding line 7 closest to the longitudinal axis $A_X$. The transition between the lines 40, 42 and the curves 41, 43 respectively at the point $P_4$, $P_5$, can be either smooth or sharp. The second edge 6 of the opening is inversely symmetrical to the first edge 5 relative to the main axis $A_M$. As can be seen from FIG. 1F, the maximum width $W_2$ is substantially constant in the space between the transition points $P_4$, $P_5$. Also, as in the case of the embodiment shown in FIG. 1A, the opening 4 extends past the folding line 7, 8 a short distance X into the respective end wall 2, 3. The opening 4 is terminated by a rounded edge 19, 20, having a substantially semicircular shape.

As for the embodiments shown in FIGS. 1A–C, it is also possible to displace the opening in the top wall in the direction of the transverse axis $A_Y$, parallel to the longitudinal axis $A_X$, for the above embodiments of FIGS. 1D–F. The angle $\alpha$ of the main axis $A_M$ can be given any value between 0° and the angle of a diagonal line between two opposing corners of the top wall. For practical reasons, however, the maximum angle is reached when one or both of the outer points 34, 36 or 44, 46, respectively, where the opening 4 intersects the folding line reaches the edge of the top wall. The general shape of the opening in the top wall need not be limited to the examples described above.

Figure 2A:
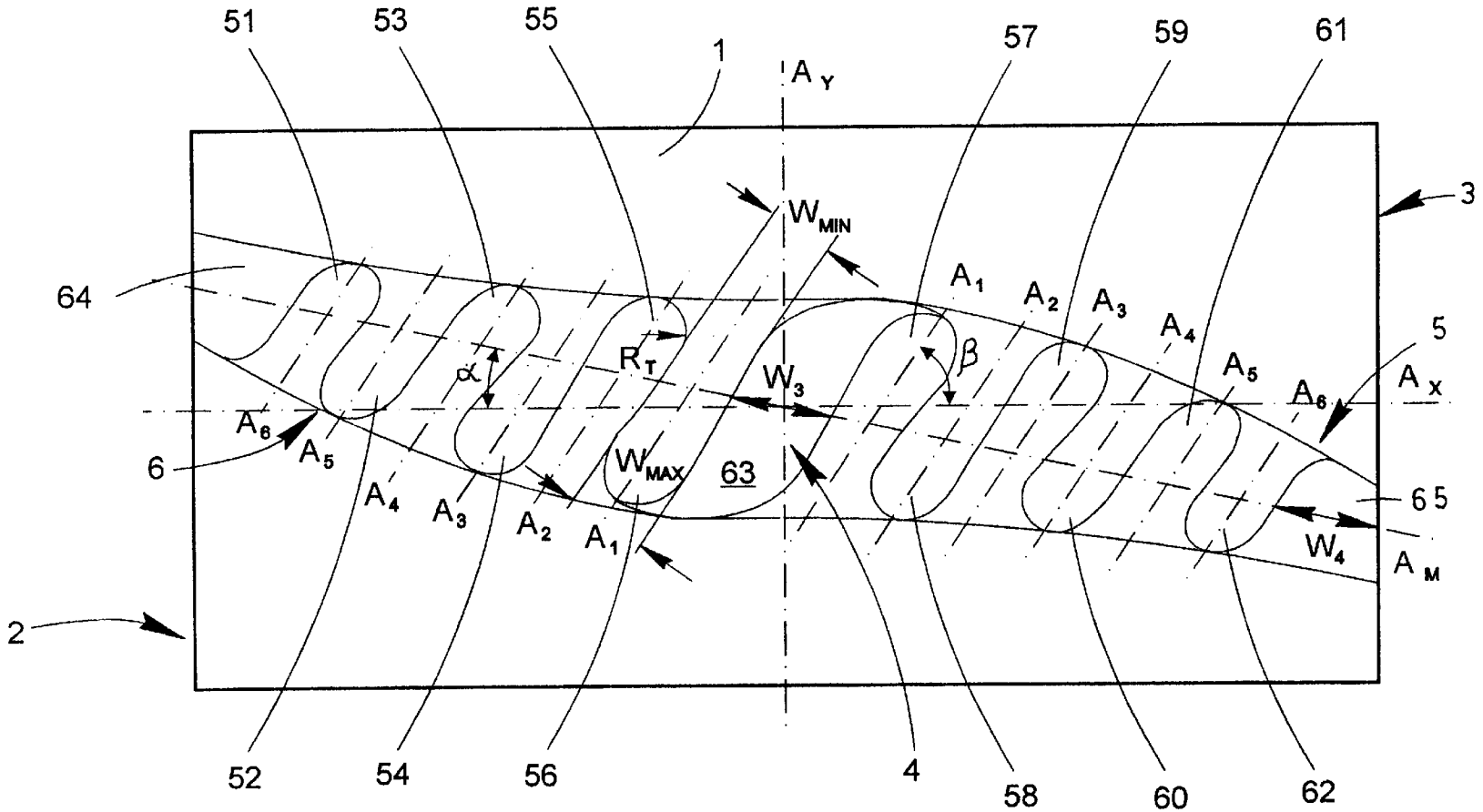
FIG. 2A shows a plan view of a top wall with an opening as shown in FIG. 1D provided with fingers according to a first embodiment.

FIG. 2A shows a plan view of a top wall 1 provided with an opening 4 as defined in relation to FIG. 1D. Attached to the underside of said top wall 1, is a sheet of plastic film provided with a cut line defining a number of fingers and cut-out sections. The fingers 51, 52; 53, 54; 55, 56; 57, 58; 59, 60; 61, 62 are arranged in co-operating pairs. In order to avoid interference from any of the neighboring pairs of fingers, the cut line between each pair of fingers has only one inflection point. As can be seen from FIG. 2A, the fingers are wider in the region of their distal tips. The main axes $A_1$, $A_2$ are indicated for the fingers 55 and 56, which make up a pair. The minimum width $W_{Min}$, at right angles to the main axis of each finger 55, 56 occurs in an inner or proximal section in the region of the base of each finger. Similarly, the maximum width $W_{Max}$, at right angles to the main axis of each finger 55, 56 occurs in an outer or distal section in the region of the distal tips. The minimum width $W_{Min}$ and the maximum width $W_{Max}$ occur on opposite sides of the main axis $A_M$ of the opening. An outer or distal section with an increased width allows a larger radius $R_T$ for the tip of each finger, which radius $R_T$ is greater than half the minimum width $W_{Min}$. By enlarging the tip of each finger, a sufficient grip is ensured between two co-operating fingers when placed in the dispensing position.

In this embodiment, each finger extends from a base adjacent one edge of the opening, to a tip near, but not overlapping, an opposite edge of the opening. As described in connection with FIG. 1D, the opening has its largest width near the central transverse axis $A_Y$ and its smallest width near the end walls of the box. Hence the length of each consecutive finger decreases from the central transverse axis $A_Y$ in the direction of the ends of the opening. The example comprises three pairs of fingers, placed inversely symmetrical on either side of said transverse axis $A_Y$. The main axes $A_1$–$A_6$ of all the fingers are placed at substantially the same angle $\beta$ in relation to the main axis $A_M$ of the opening. The main axis $A_M$ of the opening 4 is placed at an angle $\alpha$ relative to the central longitudinal axis $A_X$ of the top wall. Hence, the main axes $A_1$, $A_2$ of the fingers are at an angle $\beta$-$\alpha$ relative to said longitudinal axis $A_X$. As described in relation to FIG. 1D, the centreline $C_S$ of the opening 4 follows an S-shaped curve. Also, both a main axis $A_F$ and a centreline $C_F$ (not shown) of the cut line for the slot making up the fingers will have a substantially identical main axis and centreline as the opening 4.

The length, width and angle of each finger is chosen with respect to the type and width of tissue to be dispensed, the material and thickness of the fingers and other relevant factors. The width of the opening may be used to influence the behaviour of the fingers in the dispensing position, as described above.

A central cut-out portion 63 is arranged between two inner pairs of fingers 55, 56; 57, 58 placed on either side of the transverse axis $A_Y$ of the top wall 1. Both the innermost fingers 56, 57, adjacent the central cut-out, are arranged in substantially opposite directions, with their parallel axes $A_1$ diverging from the point of intersection of said longitudinal and transverse axes $A_X$, $A_Y$. Two further, outer cut-out portions 64, 65 are arranged at either end of the opening 4. Each outer cut-out 64, 65 is placed between and extending into, the end wall 2, 3 of the box and an outer pair of fingers 51, 52; 61, 62. The central cut-out must be sufficiently wide to allow a user to properly grip and pull a tissue up through the opening. At the same time, the width $W_3$ must not be too large, as this can cause a tissue held by the fingers to sag in its middle section. The outer cut-outs 64, 65 allow the edges of the tissues to pass through the opening without catching or snagging any part of the opening or the fingers. However, the width $W_4$ of the outer cut-outs 64, 65 must not be too large, as this can cause the corners of a tissue held by the fingers to fold. The above widths $W_3$ and $W_4$ are both measured along the main axis $A_M$ of the opening. The sizes of said widths are mainly decided by the properties, such as stiffness and thickness, of the tissue to be dispensed.

When the uppermost tissue is pulled through the central cut-out 63, the fingers will be lifted from a first, initial position, in which all fingers are in the same plane as shown in FIG. 2A, to a second, active dispensing position, in which they are bent upwards on either side of the tissue. Depending on the selected properties of the fingers, the pairs of opposing fingers will grip and hold the tissue in point or line contact therewith.

Figure 2B:
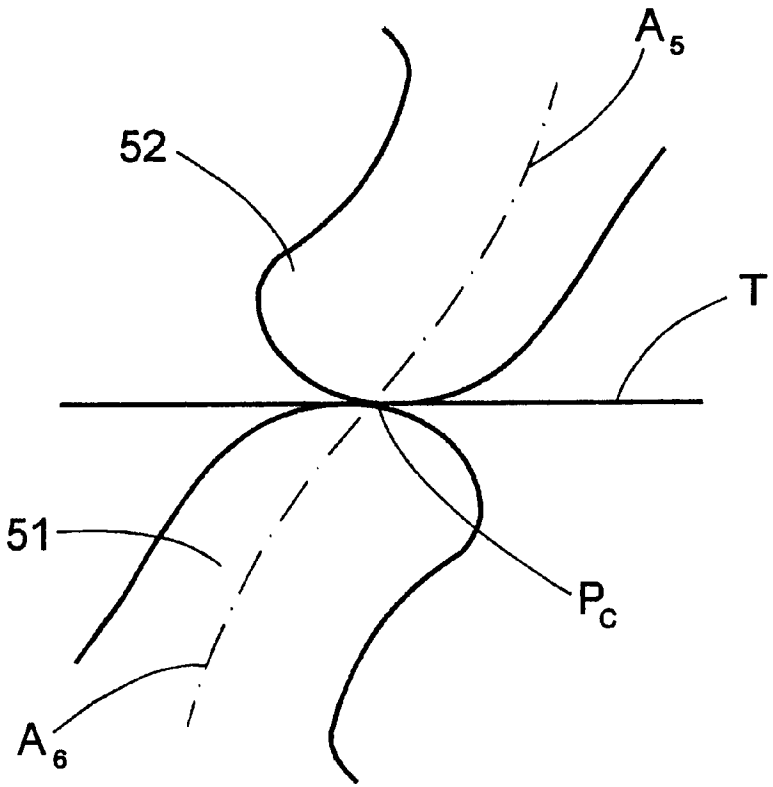
FIG. 2B shows an enlarged view of a pair of fingers in point contact.
Figure 2C:
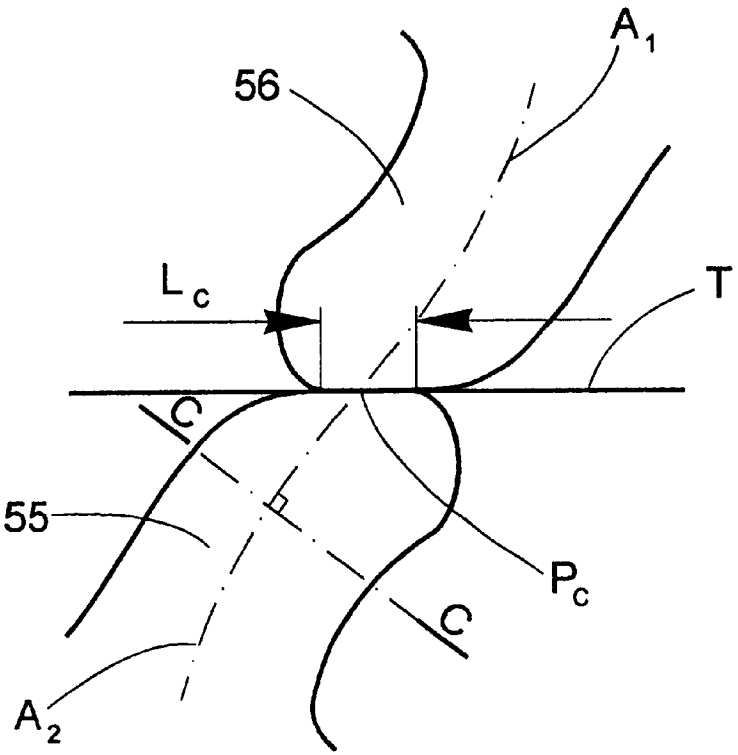
FIG. 2C shows an enlarged view of a pair of fingers in line contact.
Figure 2D:
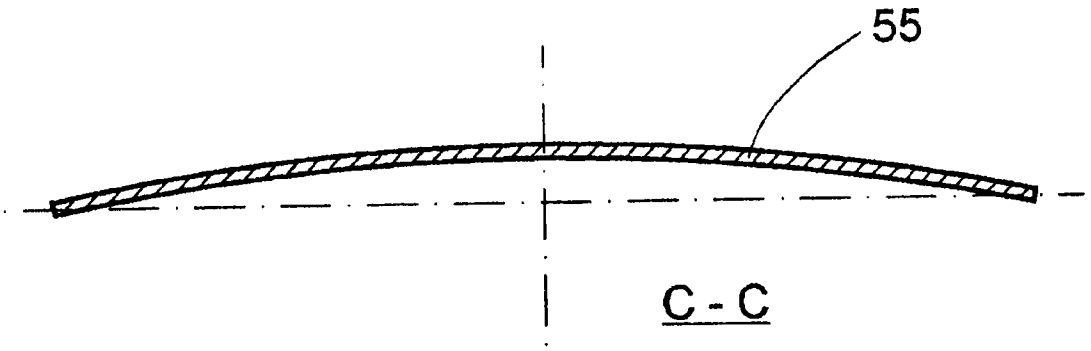
FIG. 2D shows an cross-section of a finger as disclosed in FIG. 2C.
Figure 2E:
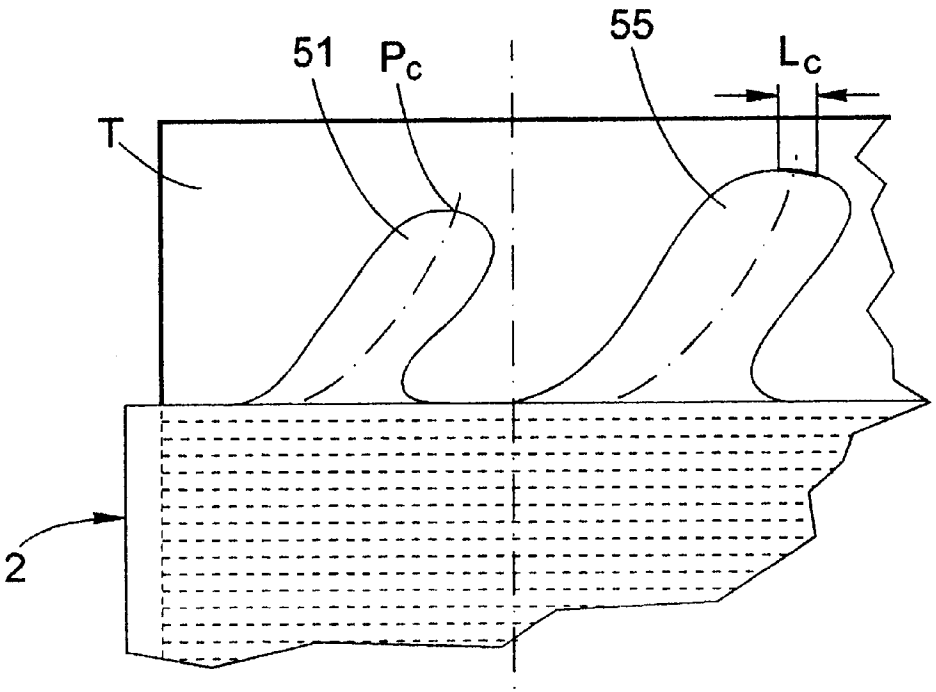
FIG. 2E shows a side view of a box, wherein one finger is in point contact and one finger is in line contact.

Fingers with a relatively high stiffness, narrow width and/or short length, will tend to be in point contact with the tissue. FIG. 2B shows an outer pair of fingers 51, 52 in the dispensing position on either side of a tissue T. Each finger contacts the tissue at a point of contact $P_C$, which point preferably but not necessarily coincides with the main axes $A_5$, $A_6$ of the respective finger. FIG. 2C shows an inner pair of fingers 55, 56 in the dispensing position. Being longer and wider, said inner pair of fingers may curve slightly around an axis parallel to the main axes $A_1$, $A_2$ of each finger. This is illustrated by the cross-section C—C, shown in FIG. 2D. Due to this curvature, the fingers will be in line contact with the tissue T along a short segment $L_C$ of the edge of each tip. Said segments will preferably but not necessarily overlap, so that the main axes $A_5$, $A_6$ at the tip of the respective finger 55, 56 coincides.

FIGS. 2B–E are shown as an example only. Depending on the desired properties for finger to be used for a specific type of tissue, it is possible to design the fingers so that all are in either point or line contact, or to use a mixture of the two.

Figure 3:
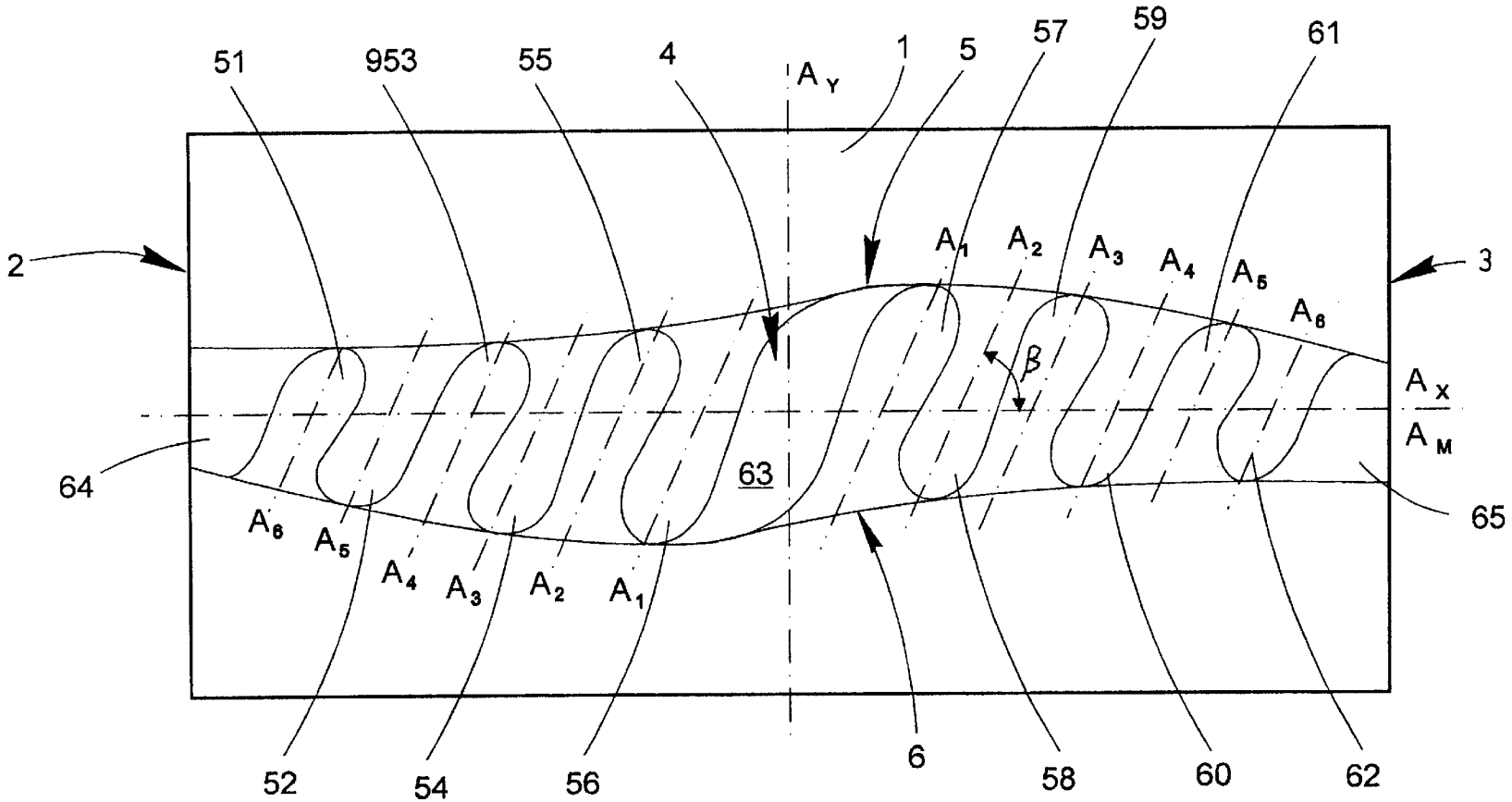
FIG. 3 shows a plan view of a top wall with an opening as shown in FIG. 1E provided with fingers according to a first embodiment.

FIG. 3 shows a plan view of a top wall 1 provided with an opening 4 as defined in relation to FIG. 1E. The difference between this embodiment and the embodiment of FIG. 2A, is that the main axis $A_M$ of the opening has been pivoted to coincide with the central longitudinal axis $A_X$ of the top wall. As an effect of this the fingers 51, 52; 53, 54; 55, 56; 57, 58; 59, 60; 61, 62 are placed at an angle β relative to the central longitudinal axis $A_X$, giving the fingers a more upright position when gripping and holding a tissue.

Figure 4:
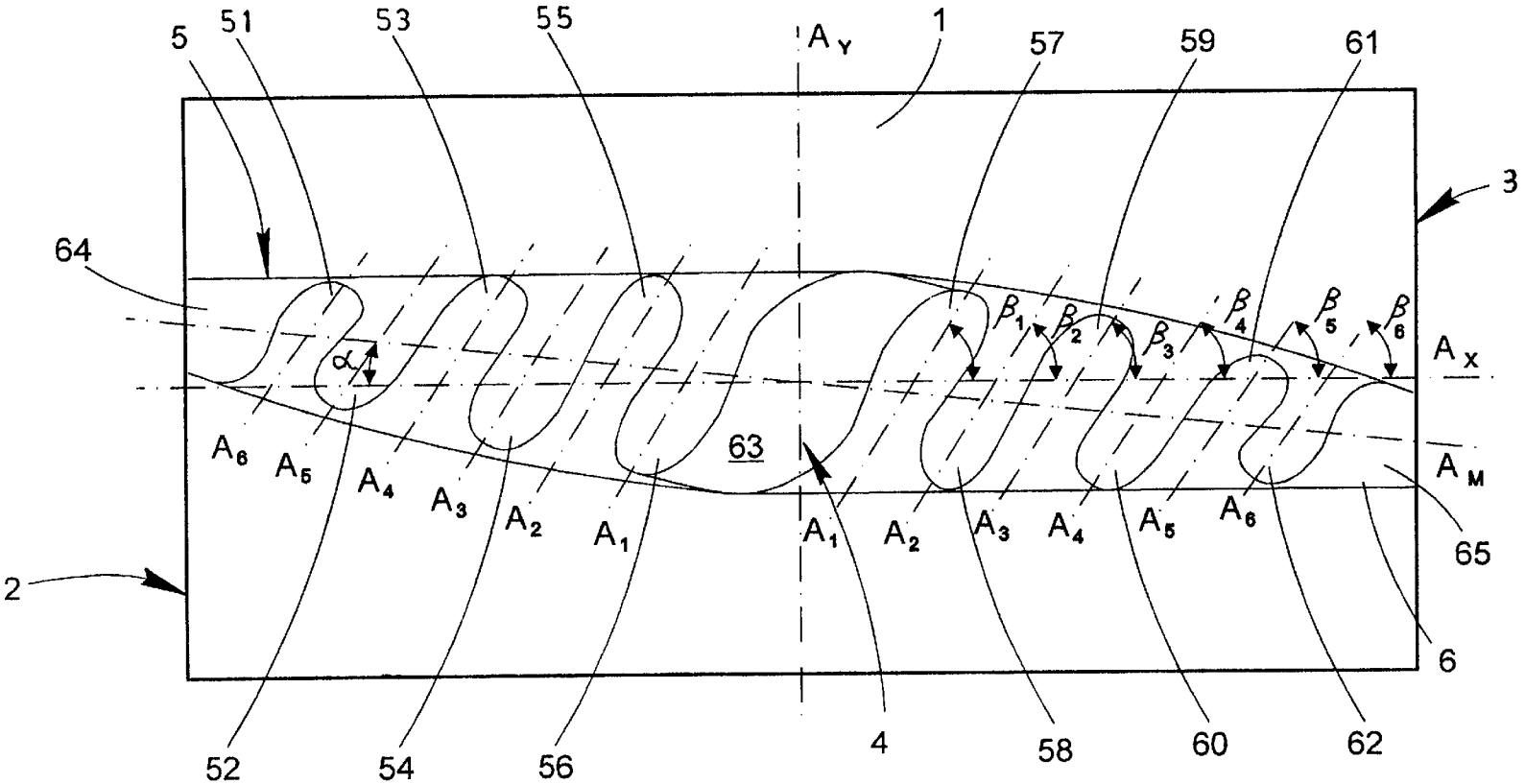
FIG. 4 shows a plan view of a top wall with an opening as shown in FIG. 1F provided with fingers according to a first embodiment.

FIG. 4 shows a plan view of a top wall 1 provided with an opening 4 as defined in relation to FIG. 1F. One of the main differences between this embodiment and the embodiments of FIGS. 2 and 3, is that the fingers are placed at different angles relative to the main axis $A_M$ of the opening 4. The main axis $A_M$ of the opening is placed at a predetermined angle α relative to the longitudinal axis $A_X$ of the top wall 1. However, the main axes $A_1$–$A_6$ of each consecutive finger 51, 52; 53, 54; 55, 56; 57, 58; 59, 60; 61, 62 on either side of the central transverse axis $A_Y$ are placed at decreasing angles relative to the main axis $A_M$ of the opening 4. Hence, the inner fingers 56, 57 on either side of the cut-out 63 have an angle $\beta_1$ relative to the main axis $A_M$. Each adjacent and opposing finger 55, 58 have an angle $\beta_2$, smaller than $\beta_1$, Similarly, the consecutive fingers 54, 59; 53, 60; 52, 61 and 51, 62 have the angles $\beta_3$, $\beta_4$, $\beta_5$, and $\beta_6$ respectively, and the relation between the angles is $\beta_1>\beta_2>\beta_3>\beta_4>\beta_5>\beta_6$.

Figure 5:
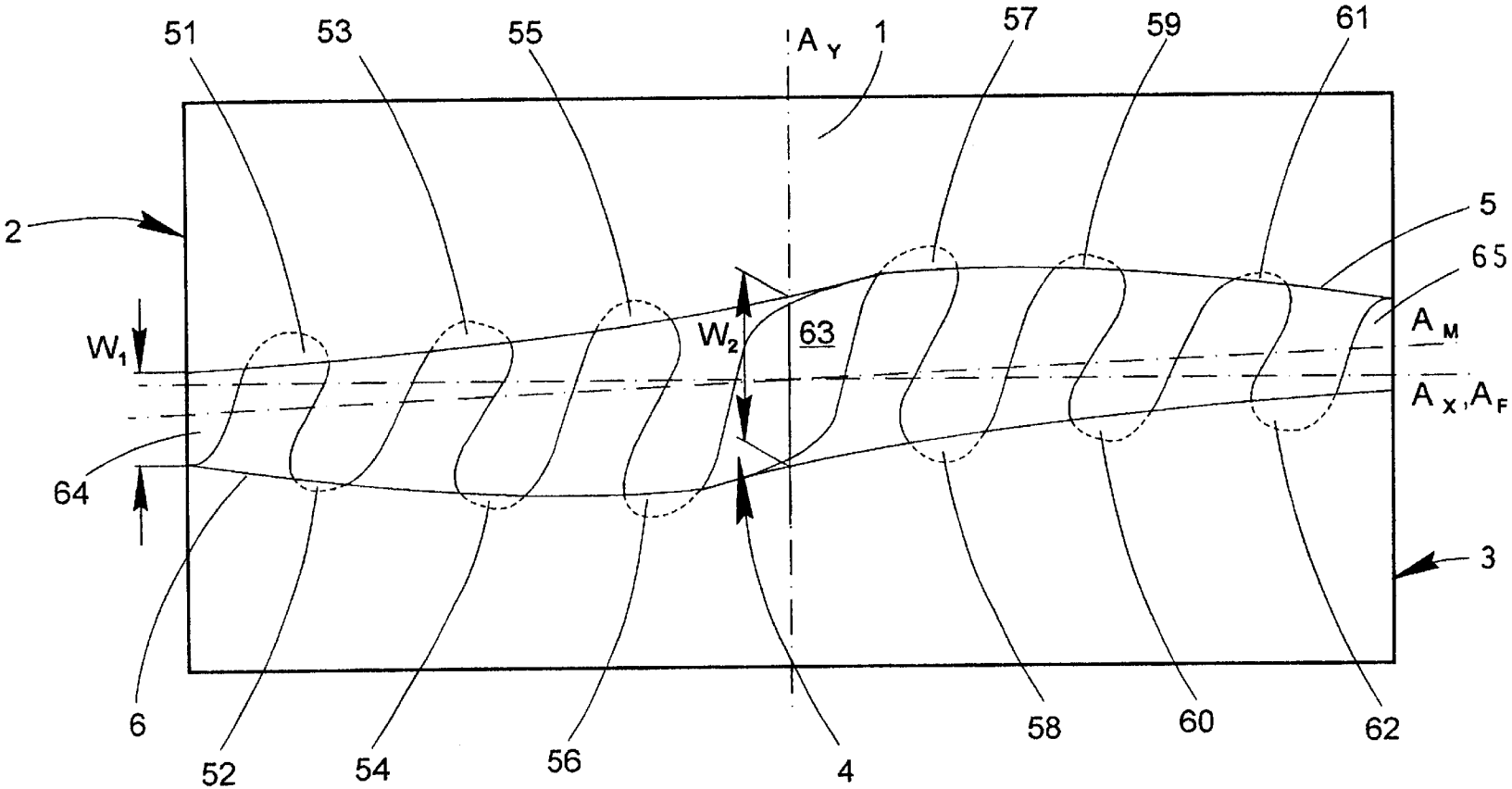
FIG. 5 shows a plan view of a top wall with an opening as shown in FIG. 1E, having a narrower width.

FIG. 5 shows a plan view of a top wall 1 provided with an opening 4 as defined in relation to FIG. 1E and fingers as defined in FIGS. 2 and 3. This embodiment has an opening with a main axis $A_M$ placed at an angle α in relation to the central longitudinal axis $A_X$ of the top wall, similar to the embodiment of FIG. 2A. The opening 4 also has a reduced width $W_1$, $W_2$ both at its ends and at its centre near the central transverse axis $A_Y$. However, the main axis $A_F$ of the slot making up the fingers coincides with said longitudinal axis $A_X$. This causes the tips of the fingers 51, 52; 53, 54; 55, 56; 57, 58; 59, 60; 61, 62 to overlap the edges 5, 6 of the opening 4. By adjusting the transverse width $W_1$, $W_2$ of the opening it is possible to adapt the stiffness and/or flexibility of the fingers to different types of tissues.

This embodiment illustrates how a variation of the size and shape of the opening can be used for adapting the properties of the fingers. This is achieved without having to replace or modify the insert containing the cut line for the slot making up the fingers. The overlap will also help to keep the fingers in their initial positions before the first tissue is removed, especially if the top wall is not provided with some kind of protective material or cover.

Figure 6:
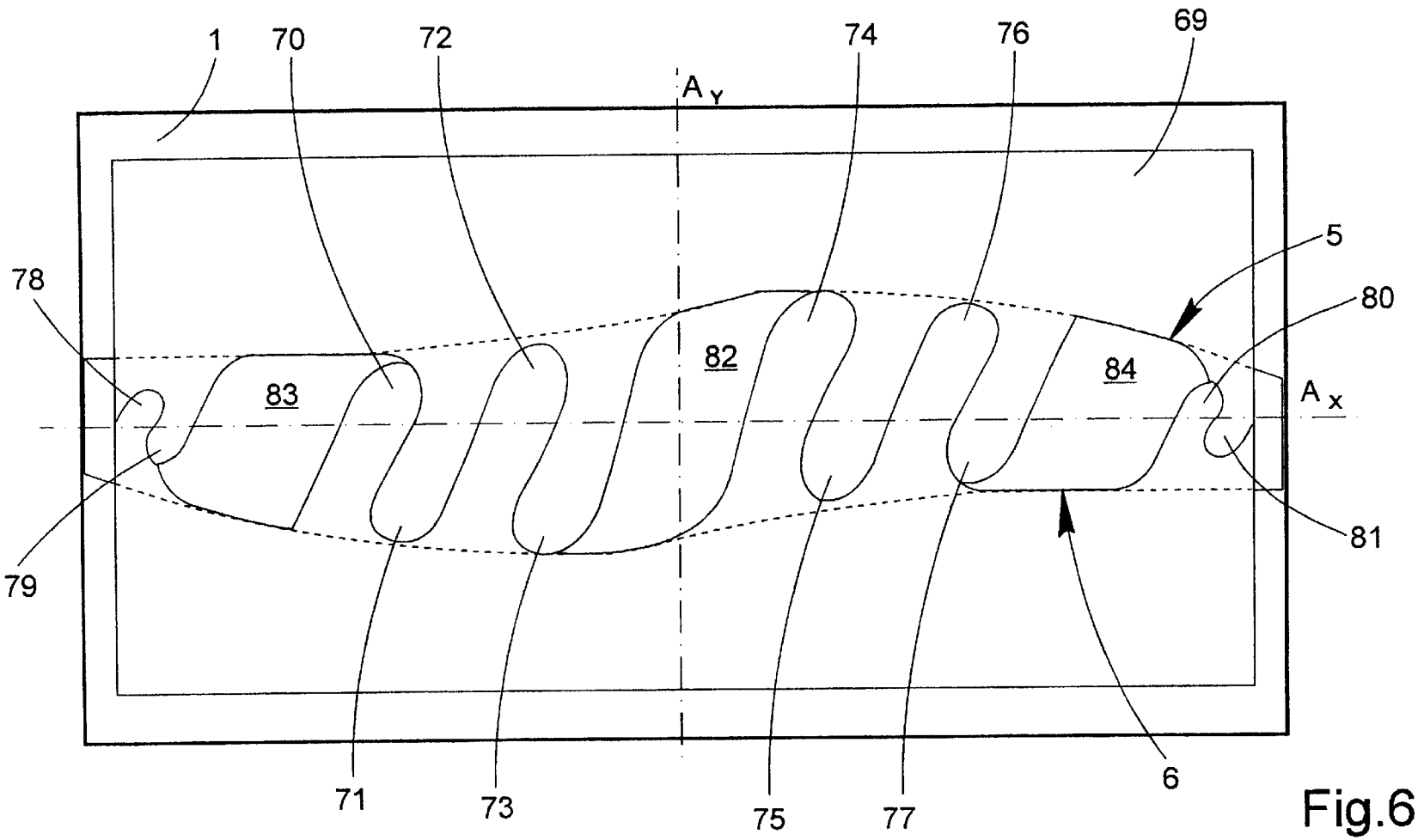
FIG. 6 shows a plan view of a top wall with an opening as shown in FIG. 1E provided with fingers according to an alternative first embodiment.

FIG. 6 shows a plan view of the underside of a top wall 1 provided with an opening 4 as defined in relation to FIG. 1E. Attached to the underside is an insert 69, comprising a plastic film with a cut line making up the fingers. The fingers have been generally defined in relation to FIGS. 2 and 3. However, the embodiment of FIG. 6 is only provided with two pairs of opposed, co-operating fingers 70, 71; 72, 73; 74, 75; 76, 77 on either side of the central transverse axis $A_Y$. An inner, first pair of fingers 72, 73; 74, 75 are placed on either side of a central cut-out 82. A second pair of fingers 70, 71; 76, 77 are placed adjacent and on either side of said first pair of fingers. An outer cut-out 83, 84 is positioned one on either side of said second pair of fingers. A further, third pair of fingers 78, 79; 80, 81 is placed between said outer cut-outs 83, 84 and the end of the opening 4 adjacent the end walls 2, 3. Said third pair of fingers 78, 79; 80, 81 have the same basic shape as the first and second pairs of fingers, which shapes have been described in connection with FIG. 2A. However, the third pair of fingers are considerably shorter than any of the other fingers shown in this embodiment, as they do not extend across the entire width of the opening 4. The purpose of these outer fingers 78, 79; 80, 81 is to support the edges of a tissue held in the dispensing position. This embodiment is used for certain types of tissues where the edges are prone to sag or curl if not properly supported. Alternatively, it will also help to smoothen the edges of a tissue as it is pulled from the box.

Figure 7:
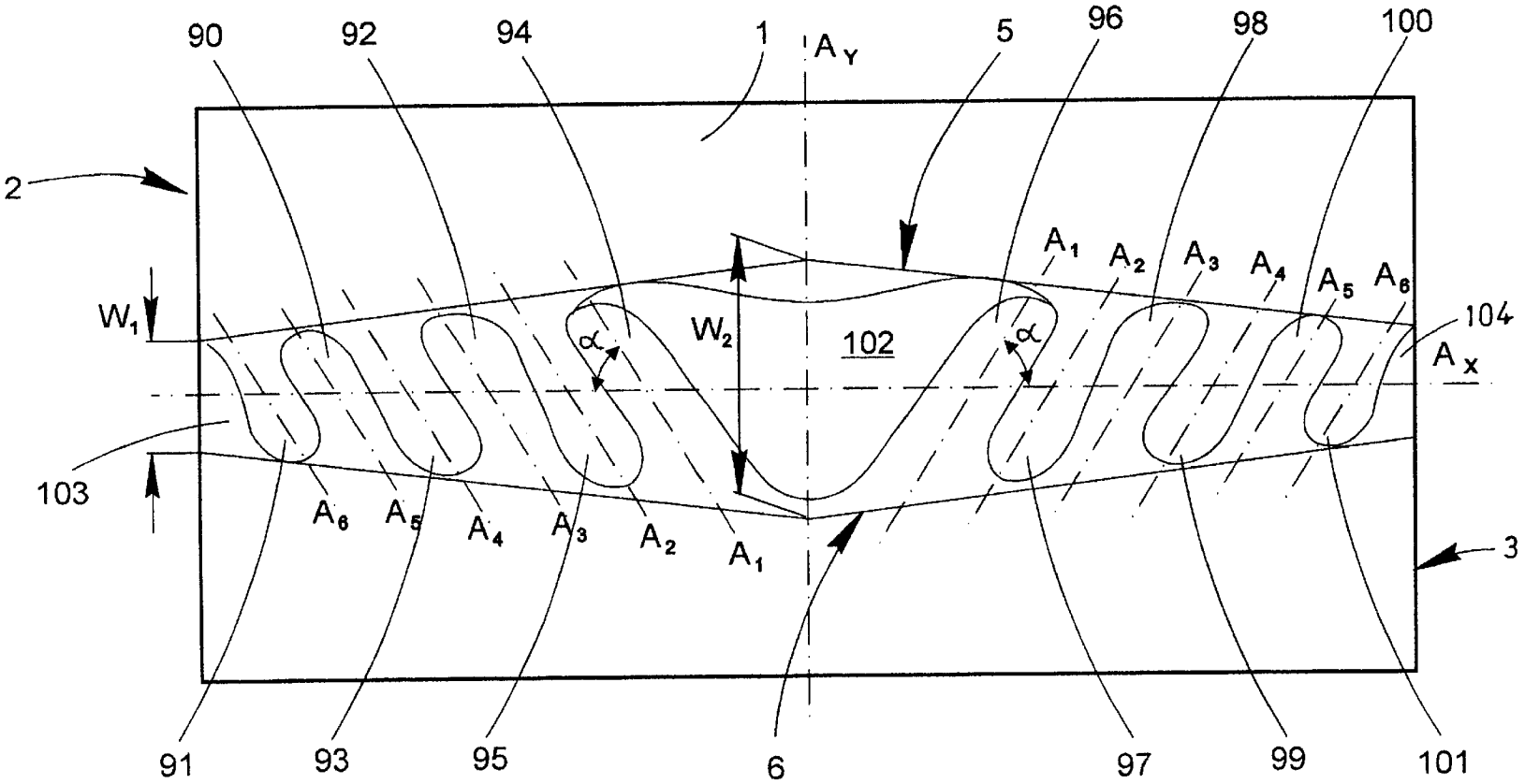
FIG. 7 shows a plan view of a top wall with an opening as shown in FIG. 1A provided with fingers according to a further alternative first embodiment.

FIG. 7 shows a plan view of a top wall 1 provided with an opening 4 as defined in relation to FIG. 1A. The fingers have been generally defined in relation to FIGS. 2 and 3. However, the embodiment shown in FIG. 7 is provided with fingers wherein the centreline $C_F$ for the cut line of the slot is a straight line coinciding with both the main axis $A_M$ of the opening 4 and the central longitudinal axis $A_X$ of the top wall 1. The shape of the fingers 90, 91; 92, 93; 94, 95; 96, 97; 98, 99; 100, 101 has been defined in connection with FIG. 2A. A central cut-out portion 102 is arranged between two inner pairs of fingers 94, 95; 96, 97 placed on either side of the central transverse axis $A_Y$. Two further, outer cut-out portions 103, 104 are arranged at either end of the opening 4. The main axes $A_1$–$A_6$ of the fingers are all placed at substantially the same angle α in relation to the longitudinal axis $A_X$.

However, the fingers are arranged symmetrically around the central transverse axis $A_Y$ only. As a consequence, the main axes of each of the corresponding fingers on either side of the transverse axis $A_Y$ will intersect on that axis $A_Y$. Hence the innermost fingers 94, 96 will diverge from each other on either side of the transverse axis $A_Y$, but on the same side of the longitudinal axis $A_X$. This arrangement allows a larger central cut-out 102, which makes the upper tissue more accessible to the user when the first tissue is to be pulled out. In addition, the diverging innermost fingers 94, 96 will to a certain extent stretch and smoothen the central part of a tissue held in the presentation position.

Figure 8:
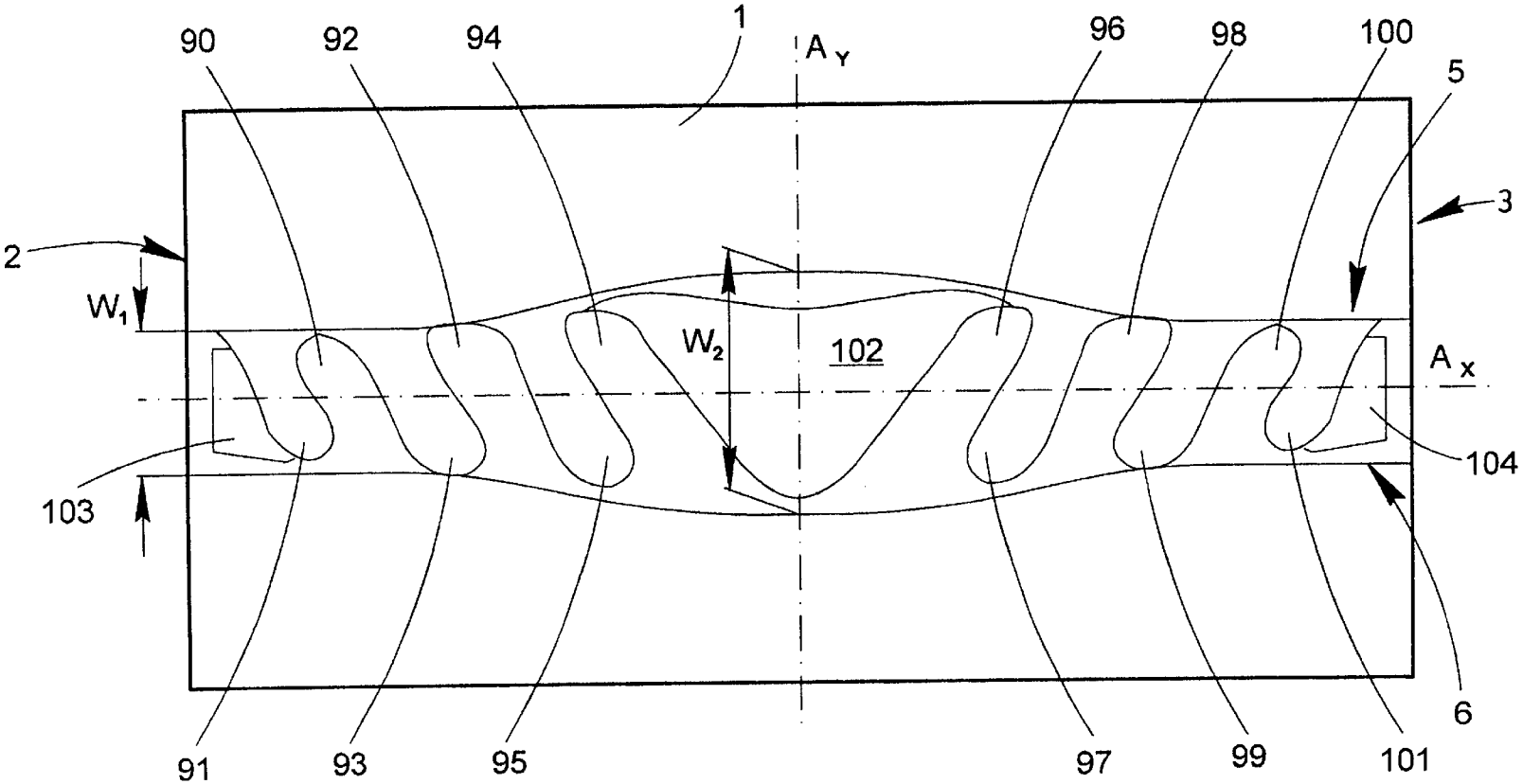
FIG. 8 shows a plan view of a top wall with an opening as shown in FIG. 1C provided with fingers according to a further alternative first embodiment.

FIG. 8 shows an alternative embodiment of the arrangement in FIG. 7, using a top wall with an opening as described in connection with FIG. 1C. As stated above, adjusting the transverse width $W_1$, $W_2$ of the opening makes it possible to adapt the stiffness and/or flexibility of the fingers to different types of tissues.

Figure 9:
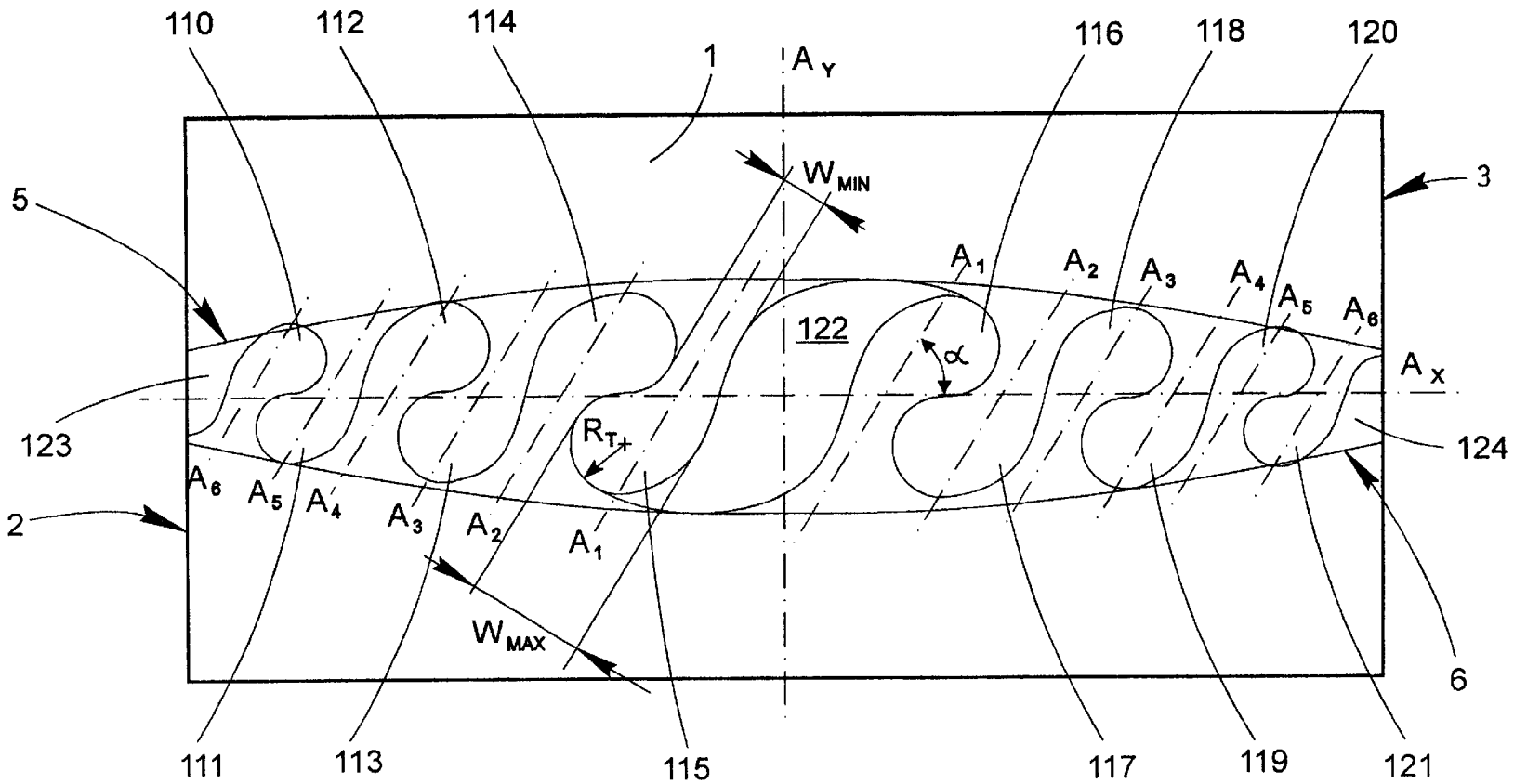
FIG. 9 shows a plan view of a top wall with an opening as shown in FIG. 1B provided with fingers according to a second embodiment.

FIG. 9 shows a plan view of a top wall 1 provided with an opening 4 as defined in relation to FIG. 1B. In this second embodiment of the fingers, the shape has been modified in order to allow the tips to be enlarged further. The embodiment shown in FIG. 9 is provided with fingers wherein the centreline $C_F$ for the cut line of the slot is a straight line coinciding with both the main axis $A_M$ of the opening 4 and the central longitudinal axis $A_X$ of the top wall 1. The fingers 110, 111; 112, 113; 114, 115; 116, 117; 118, 119; 120, 121 have their main axes A1–A12 placed at substantially the same angle α relative to the longitudinal axis $A_X$. According to this embodiment, the minimum width $W_{Min}$, at right angles to the main axis of each finger occurs in an inner section. Similarly, the maximum width $W_{Max}$, at right angles to the main axis of each finger occurs in an outer section. The minimum width $W_{Min}$ and the maximum width $W_{Max}$ occur on opposite sides of the main axis $A_M$ of the opening. In this embodiment the maximum width $W_{Max}$ is in excess of twice the minimum width $W_{Min}$. The outer section having an increased width allows a larger radius $R_T$ for the tip of each finger, which radius $R_T$ is greater than the minimum width $W_{Min}$.

This has been achieved by curving the cut line outer section of each finger of a co-operating pair towards the inner section of a corresponding opposing finger. The cut line between each pair of fingers will only have one inflection point, in order to avoid interference between adjacent fingers. In their plane, initial position the fingers of each pair of fingers will be curved into one another in an interlocking position. The surface area of an outer section of a finger is made larger than the surface area of an inner section. In this case the inner and outer sections are arranged on either side of the centreline $C_F$ for the cut line of the slot, coinciding with the central longitudinal axis $A_X$. Hence the area of the outer section is encompassed by the edge of an outer part of a finger, including the tip, delimited by the centreline of the opening. The area of the inner section is encompassed by a pair of edges on either side of an inner part of a finger, delimited by the centreline of the opening on one side and a line drawn at a tangent to, and extrapolated past the tips of all adjacent fingers on the respective sides of the opening. The latter line is the base of the finger.

The maximum and minimum widths of each finger can be varied to achieve a desired tip radius. However, the widths must be in proportion to the extended length and required stiffness of a finger. The length of a finger is dependent on the transverse width of the opening in the region of the finger. In order to maintain a certain stiffness and flexibility for a finger having a predetermined length, there will be a lower limit for the minimum width $W_{Min}$. This will determine an upper limit for the maximum width $W_{Max}$, which in turn decides the largest possible tip radius $R_T$.

As for several of the above embodiments, a central cut-out portion 123 is arranged between two inner pairs of fingers 114, 115; 116, 117 placed on either side of the transverse axis $A_Y$ of the top wall 1. Both the innermost fingers 115, 116, adjacent the central cut-out, are arranged in substantially opposite directions, with their parallel axes $A_1$ diverging from the point $P_0$ of intersection of said longitudinal and transverse axes $A_X$, $A_Y$. Two further, outer cut-out portions 123, 124 are arranged at either end of the opening 4. Each outer cut-out 123, 124 is placed between and extending into, the end wall 2, 3 of the box and an outer pair of fingers 110, 111; 120, 121.

Figure 10:
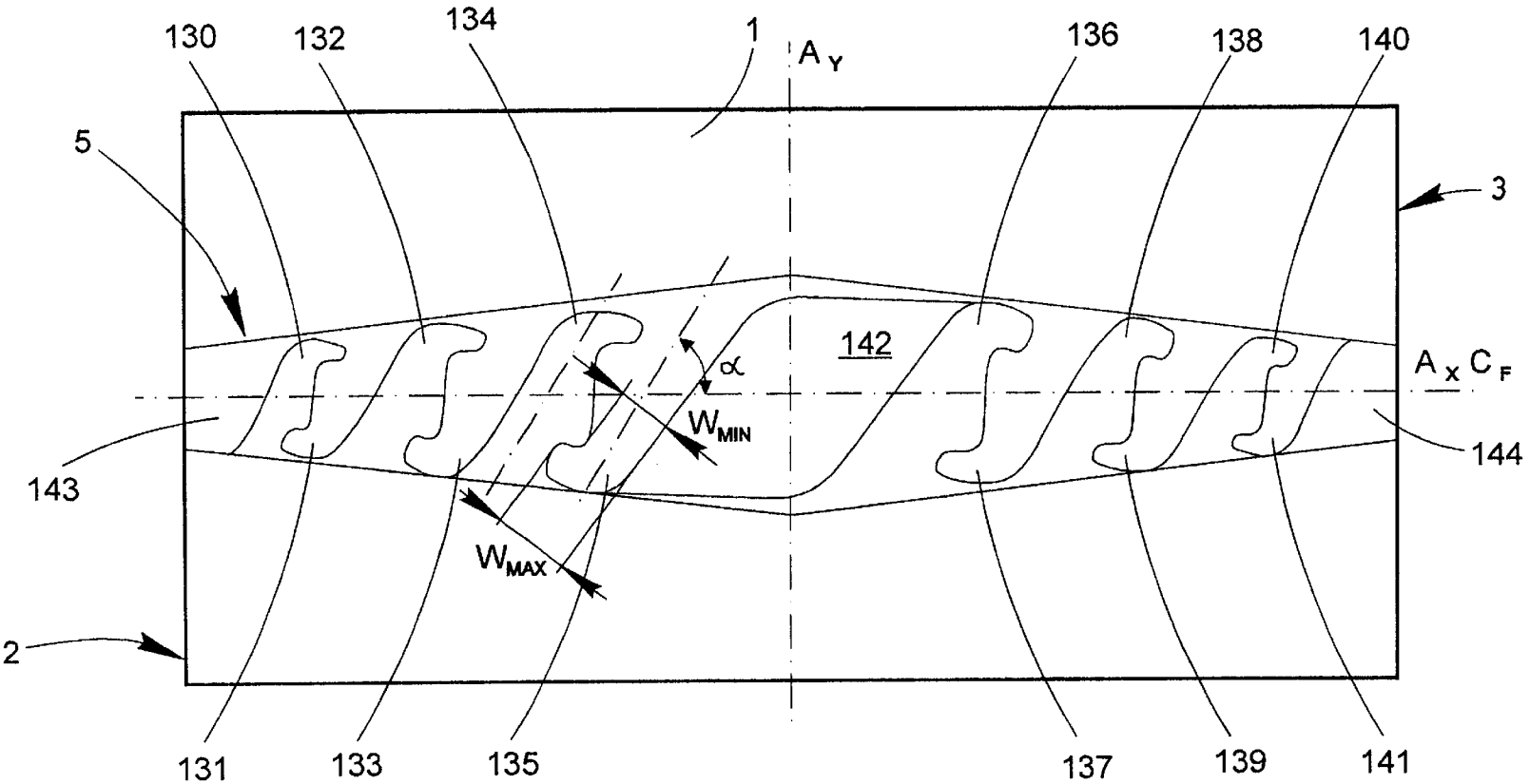
FIG. 10 shows a plan view of a top wall with an opening as shown in FIG. 1A provided with fingers according to a third embodiment.

FIG. 10 shows a plan view of a top wall 1 provided with an opening 4 as defined in relation to FIG. 1A. This figure shows a third embodiment of the fingers, which have been given a shape that allows a relatively large tip radius without enlarging the surface area of an outer section of the finger. The opening 4 in this embodiment is provided with fingers having a centreline $C_F$ for the cut line of the slot is a straight line coinciding with both the main axis $A_M$ of the opening 4 and the central longitudinal axis $A_X$ of the top wall 1. The fingers 130, 131; 132, 133; 134, 135; 136, 137; 138, 139; 140, 141 have their main axes $A_1$–$A_6$ placed at substantially the same angle α relative to the longitudinal axis $A_X$.

In order to increase the width of an outer section of the fingers, each of the tips of a pair of adjacent, opposing fingers have been angled towards each other. This has been achieved by curving or bending the cut line of the outer section of each tip of a co-operating pair of fingers towards the inner section, or base, of a corresponding opposing finger. Each such finger has a general J- or L-shape, depending on the curvature or the angle of the tip. By extending the curved or bent section of the tip in the longitudinal direction of the opening 4, it is possible to achieve a larger tip radius $R_T$. The cut line between each pair of fingers will only have one inflection point, in order to avoid interference between adjacent pairs of fingers. In their plane, initial position the tips of each pair of fingers will be curved or bent into a corresponding recess in the other in an interlocking position.

As the angled tip extends into the base or lower section of an adjacent finger, the width of the tip is limited by the required stiffness and flexibility of the adjacent finger at that point. In the example shown, the maximum width $W_{Max}$ of the outer section, or tip, of a particular finger is substantially equal to the corresponding inner section at the base of said finger. The minimum width $W_{Min}$ will instead occur near the inner corner of the J- or L-shaped finger, in the vicinity of the tip. Hence both the maximum and minimum widths occur on the same side of the central longitudinal axis $A_X$.

A central cut-out portion 143 is arranged between two inner pairs of fingers 134, 135; 136, 137 placed on either side of the transverse axis $A_Y$ of the top wall 1. Both the innermost fingers 135, 136, adjacent the central cut-out, are arranged in substantially opposite directions, with their parallel axes $A_1$ diverging from the point $P_0$ of intersection of said longitudinal and transverse axes $A_X$, $A_Y$. Two further, outer cut-out portions 143, 144 are arranged at either end of the opening 4. Each outer cut-out 143, 144 is placed between and extending into, the end wall 2, 3 of the box and an outer pair of fingers 130, 131; 130, 131.

Although the example shows fingers having tips with a general J- or L-shape, alternative shapes, or combinations of shapes, are of course possible. One such alternative tip could for instance have a T-shape. A cut line for the slot making up the fingers could also contain a number of pairs of fingers, wherein each pair could have differently shaped fingers.

Figure 11:
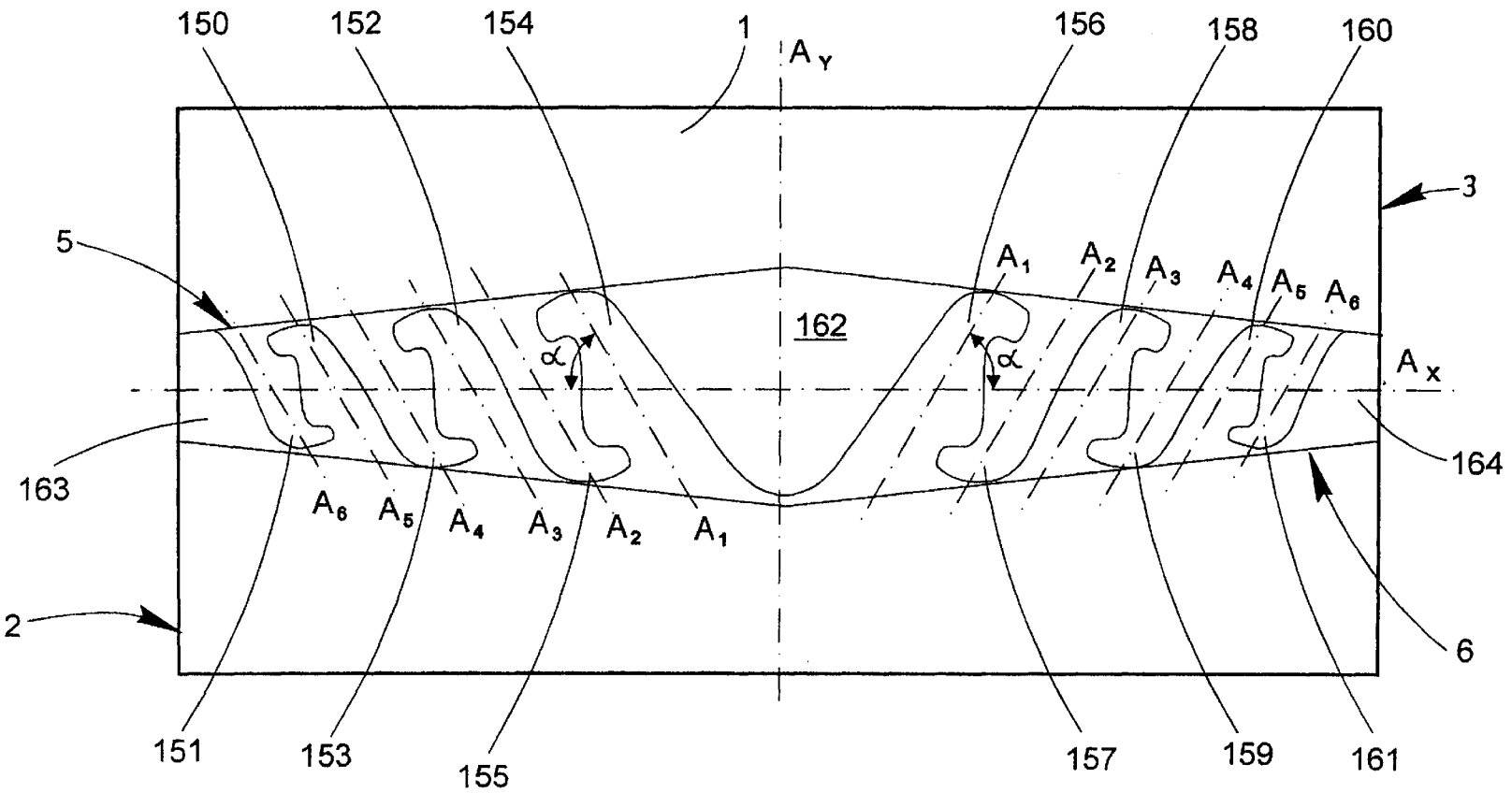
FIG. 11 shows a plan view of a top wall with an opening as shown in FIG. 1A provided with fingers according to an alternative third embodiment.3

FIG. 11 shows a plan view of a top wall 1 provided with an opening 4 as defined in relation to FIG. 1A. The embodiment shown in FIG. 11 is provided with fingers wherein the centreline $C_F$ for the cut line of the slot is a straight line coinciding with both the main axis $A_M$ of the opening 4 and the central longitudinal axis $A_X$ of the top wall 1. The shape of the fingers 150, 151; 152, 153; 154, 155; 156, 157; 158, 159; 160, 161 has been defined in connection with FIG. 10. A central cut-out portion 162 is arranged between two inner pairs of fingers 154, 155; 156, 157 placed on either side of the central transverse axis $A_Y$. Two further, outer cut-out portions 163, 164 are arranged at either end of the opening 4. The main axes $A_1$–$A_6$ of the fingers are all placed at substantially the same angle α in relation to the longitudinal axis $A_X$.

However, the fingers are arranged symmetrically around the central transverse axis $A_Y$ only. As a consequence, the main axes of each of the corresponding fingers on either side of the transverse axis $A_Y$ will intersect on that axis $A_Y$. Hence the innermost fingers 154, 156 will diverge from each other on either side of the transverse axis $A_Y$, but on the same side of the longitudinal axis $A_X$. This arrangement allows a larger central cut-out 162, which makes the upper tissue more accessible to the user when the first tissue is to be pulled out. In addition, the diverging innermost fingers 154, 156 will to a certain extent stretch and smoothen the central part of a tissue held in the presentation position.

According to a further embodiment of the invention, the top wall includes the opening and the fingers in one piece. In this case the cut line of the slot making up the fingers is arranged directly in the top wall. In this case the box itself, or at least the top wall, is made from a plastic material, having projections or fingers cut or perforated in the top wall. A line defining the opening, which would normally control the movement of the fingers, can be embossed directly on the top wall. It is also possible to provide each individual finger with a specific embossing or pattern, in order to give each finger a predetermined flexibility. The stiffness and flexibility of the fingers can also be controlled by the thickness of the material in the top wall. The shape of the slot containing the projections or fingers or the positioning and shape of the embossed opening varied in accordance with the above examples.

This embodiment, wherein a closed opening is cut directly in the top wall, can be used for all examples described above, with the exception of that of FIG. 5, which discloses fingers that overlap the edge of the opening. In this particular case, the opening would need to comprise two separate sets of fingers cut in a top wall made up of two halves on opposite sides of a blank for a box. When folded into a box, the blank including the opposed halves of the top wall will be folded along folding lines substantially parallel to the final opening. The two halves of the top wall will eventually be folded around until they reach a position where the cut fingers face each other in a common plane. In this way the fingers can be made longer than what would be possible using a single cut line between opposing fingers. The amount of overlap can be controlled by adjusting the length of the fingers. Similarly, the embossed line defining the opening can be made at any desired position adjacent or overlapping the base of the fingers.

What is claimed is:

1. A container for a collection of interfolded or mechanically connected tissue-sheets, said container comprising:

a generally planar bottom wall and a top wall and a pair of side walls and end walls connecting said bottom wall with said top wall and an opening provided in at least said top wall for the removal of the tissue-sheets from the container, the stack of interfolded tissue-sheets being placed in said container with at least a pair of edges of a lowermost tissue-sheet placed on said bottom wall and an uppermost tissue-sheet placed near or in contact with the top wall and adjacent to the opening in the top wall, wherein the opening is provided with elongated projections extending from opposite sides of the opening, wherein each projection in an initial position extends across the opening in the plane of said top wall and is positioned adjoining at least one opposing projection, and the projections are arranged in co-operating pairs, wherein each projection has at least one inner proximal base section having a smaller width than an adjacent outer distal tip section.

2. A container according to claim 1, wherein the said widths of the respective inner and outer sections are the transvers width in the perpendicular direction of a main axis of said projection.

3. A container according to claim 1, wherein the said width of the respective inner and outer sections is the transverse width in the direction of a central longitudinal axis of said opening.

4. A container according to claim 1, wherein each projection has a radius at its tip that is greater than half the width of the projection at its narrowest section.

5. A container according to claim 1, wherein the projections of at least one pair of opposing projections are provided with at least one outer section with a surface area that is larger than the surface area of an inner section, having a corresponding length along a main axis of each respective projection.

6. A container according to claim 5, wherein the area of the outer section extending past a central longitudinal axis of the opening is larger than the surface area of the inner section from said axis to a base of the projection.

7. A container according to claim 1, wherein tips of each pair of co-operating projections are shaped so as to come into line contact with a tissue, when moved from the initial position to a dispensing position.

8. A container according to claim 1, wherein tips of each pair of co-operating projections are shaped so as to come into point contact with a tissue, when moved from the initial position to a dispensing position.

9. A container according to claim 1, wherein a main axis of the opening containing said projections extends across the top wall parallel to a central longitudinal axis of the top wall.

10. A container according to claim 1, wherein a main axis of the opening containing said projections extends across the top wall at an angle with respect to the central longitudinal axis of the top wall.

11. A container according to claim 10, wherein the angle can be given any value on either side of said longitudinal axis up to and including an angle corresponding to the angle of a diagonal line between opposing corners of the top wall.

12. A container according to claim 1, wherein a centreline of the opening containing said projections extends across the top wall in a generally S-shaped curve extending in the direction of the main axis of the opening.

13. A container according to claim 1, wherein the projections extend across the opening to overlap an edge of the opposing side of the opening, so that tips of the projections extend past said edges.

14. A container according to claim 1, wherein the opening is provided with a shaped cut line that forms said opposing projections.

15. A container according to claim 14, wherein said cut line is arranged in an insert or sheet attached to the underside of the top wall, which contains the opening.

16. A container according to claim 14, wherein said cut line is cut directly in the top wall.

17. A container according to claim 16, wherein a pair of edges corresponding to the shape of the opening are embossed in the top wall on either side of the cut line.

18. A container according to claim 14, wherein said cut line has at least one removable cut-out section giving access to the uppermost tissue-sheet.

19. A container according to claim 18, wherein a first cut-out is arranged at the centre of the opening, having a pair of projections arranged on either side thereof.

20. A container according to claim 19, wherein a pair of second cut-outs are arranged one at either end of the opening, between a pair of projections and an end wall.

21. A container according to claim 19, wherein a pair of second cut-outs are arranged one near either end of the opening, having a pair of projections arranged on either side thereof.

* * * * *